US006884051B2

(12) United States Patent
Niikura et al.

(10) Patent No.: US 6,884,051 B2
(45) Date of Patent: Apr. 26, 2005

(54) ROTARY FLUID MACHINERY

(75) Inventors: Hiroyuki Niikura, Wako (JP); Hiroyoshi Taniguchi, Wako (JP); Tsuyoshi Baba, Wako (JP); Kensuke Honma, Wako (JP); Hiroyuki Horimura, Wako (JP); Tsuneo Endoh, Wako (JP); Yasunobu Kawakami, Wako (JP); Yasunari Kimura, Wako (JP); Ryuji Sano, Wako (JP); Kenji Matsumoto, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/239,513

(22) PCT Filed: Mar. 22, 2001

(86) PCT No.: PCT/JP01/02291

§ 371 (c)(1),
(2), (4) Date: Feb. 27, 2003

(87) PCT Pub. No.: WO01/71161

PCT Pub. Date: Sep. 27, 2001

(65) Prior Publication Data

US 2003/0165393 A1 Sep. 4, 2003

(30) Foreign Application Priority Data

| | | |
|---|---|---|
| Mar. 23, 2000 | (JP) | 2000-087076 |
| Mar. 23, 2000 | (JP) | 2000-087077 |
| Mar. 23, 2000 | (JP) | 2000-087078 |
| Sep. 4, 2000 | (JP) | 2000-271510 |

(51) Int. Cl.[7] ..... F03C 2/00

(52) U.S. Cl. ..... 418/268; 418/144; 418/195; 91/494

(58) Field of Search ..... 418/268, 144, 418/195; 91/494, 491, 492

(56) References Cited

U.S. PATENT DOCUMENTS

| | | | | | |
|---|---|---|---|---|---|
| 2,386,459 | A | * | 10/1945 | Hautzenroeder | 192/60 |
| 3,123,013 | A | | 3/1964 | Ganahl | |
| 3,690,097 | A | * | 9/1972 | Widmaier | 91/492 |
| 4,776,258 | A | * | 10/1988 | Eickmann | 91/491 |

FOREIGN PATENT DOCUMENTS

| | | | | | |
|---|---|---|---|---|---|
| JP | 54-71403 | A | | 6/1979 | |
| JP | 53-48706 | A | | 3/1983 | |
| JP | 58-126478 | A | | 7/1983 | |
| JP | 58126478 | A | * | 7/1983 | F04B/1/20 |
| JP | 2001-132411 | A | | 5/2001 | |
| JP | 2001-132672 | A | | 5/2001 | |
| WO | 00/14411 | A1 | | 3/2000 | |
| WO | WO 3027442 | A1 | * | 4/2003 | F01C/1/344 |

* cited by examiner

*Primary Examiner*—Theresa Trieu
(74) *Attorney, Agent, or Firm*—Birch, Stewart, Kolasch & Birch, LLP

(57) ABSTRACT

An outer periphery of an output shaft integral with a rotor of an expander of a vane-type operated by a high-pressure vapor is supported at its opposite ends by a static-pressure bearing mounted at one end thereof in a floated state provided by a liquid film of a pressurized liquid-phase fluid supplied from a pressurized liquid-phase fluid feed bore through a pressurized liquid-phase fluid passage, and by a static-pressure bearing mounted at the other end thereof in a floated state provided by a liquid film of a pressurized liquid-phase fluid supplied from a pressurized liquid-phase fluid feed bore through pressurized liquid-phase fluid passages. Vanes supported radially in the rotor for reciprocal movement are supported in floated states by a liquid film of a pressurized liquid-phase fluid supplied through pressurized liquid-phase fluid passages extending radially outwards within the rotor.

14 Claims, 20 Drawing Sheets

ROTARY FLUID MACHINERY

This application is the national phase under 35 U.S.C. §371 of PCT International Application No. PCT/JP01/02291 which has an International filing date of Mar. 22, 2001, which designated the United States of America.

FIELD OF THE INVENTION

The present invention relates to a rotary fluid machine for converting a pressure energy of a high-pressure gas-phase operating medium into a mechanical energy to take out the mechanism energy from an output shaft.

BACKGROUND ART

A Ranking cycle system is described in Japanese Patent Application Laid-open No. 58-48706, which is designed, so that a high-pressure gas-phase operating medium generated by heating a liquid-phase operating medium in an evaporator is expanded in an expander to take out a mechanical energy, and the resulting low-pressure gas-phase operating medium is cooled in a condenser and restored to a liquid-phase operating medium, which is supplied again to the evaporator by a pump. In the above-described conventional system, an expander of a vane-type is used as a rotary fluid machine constituting the expander.

It should be noted here that in the expander of the vane-type, it is necessary to lubricate a bearing portion of the output shaft rotated in unison with a rotor and sliding portions of vanes radially movably supported on the rotor. However, the sliding portions are exposed to severe conditions of a high temperature and a high pressure and hence, there is a possibility that the seizure and the wearing may occur, if an effective lubricating means is not employed.

In the expander of the vane-type, vanes reciprocally movably supported in slot-shaped spaces provided radially in the rotor are pushed circumferentially by the gas-phase operating medium supplied to a rotor chamber to rotate the rotor. For this reason, a special lubricating means is required in order to prevent the occurrence of the seizure and wearing due to the gouging generated in the sliding portion of vane in the slot-shaped space.

Further, the expander of the vane-type suffers from the following problem: It is necessary to provide a clearance as large as 50 $\mu$m on one side between side faces of the rotor and an inner surface of the casing in order to permit the deflection generated due to a clearance at the bearing portion of the rotor, and the high-pressure gas-phase operating medium in the rotor chamber may be leaked from the clearance. If a common contact-type seal member is used in order to prevent the leakage of the gas-phase operating medium from the clearance between the side face of the rotor and the inner surface of the casing, not only a loss due to the friction is produced, but also the durability of the seal member is feared. In addition, it is substantially difficult to achieve the sealing with the clearance between the side face of the rotor and the inner surface of the casing being simply decreased, because of the limit of the accuracy of the bearing portion of the rotor.

If an annular seal means is disposed between each of the side faces of the rotor and the inner surface of the casing in order to prevent the leakage of the gas-phase operating medium from the clearance between the side face of the rotor and the inner surface of the casing, then the pressure of the gas-phase operating medium in the rotor chamber is not constant in a circumferential direction, and is high in an expansion stroke of the gas-phase operating medium and low in an exhaust stroke of the gas-phase operating medium. Therefore, if a sealing force required in the expansion stroke in which the pressure is high is provided equally over the entire periphery of the annular seal means, the following problem is encountered: The sealing force is excessive in the exhaust stroke in which the pressure is low and hence, the useless frictional resistance is increased, resulting in an energy loss.

DISCLOSURE OF THE INVENTION

The present invention has been accomplished with the above circumstances in view, and it is a first object of the present invention to ensure that various sliding portions in the rotary fluid machine of the vane-type can be lubricated effectively.

It is a second object of the present invention to ensure that each of the vanes of the rotary fluid machine of the vane-type is supported in a floated state to prevent the solid contact of the vane with the rotor, thereby exhibiting a lubricating effect to prevent the occurrence of the seizure and the wearing.

It is a third object of the present invention to ensure that a static-pressure bearing is formed on a sliding portion of the sealing means to bring the sealing means in a floated state, while sealing the clearance between each of the side faces of the rotor of the rotary fluid machine of the vane-type and the inner surface of the casing by the sealing means, thereby enabling the effective lubrication to prevent the occurrence of the seizure and the wearing.

It is a fourth object of the present invention to ensure that when the clearance between each of the side faces of the rotor of the rotary fluid machine of the vane-type and the inner surface of the casing is sealed by the sealing means, both of the ensuring of the sealability and the reduction in frictional resistance are reconciled.

To achieve the first object, according to a first aspect and feature of the present invention, there is provided a rotary fluid machine comprising a casing having a rotor chamber, a rotor accommodated in the rotor chamber, and a plurality of vane piston units disposed in the rotor radially about a rotational axis of the rotor for reciprocal movement in a radial direction, each of the vane piston units comprising a vane slidable in the rotor chamber and a piston abutting against a non-sliding portion of the vane, so that the piston is operated by the expansion of a high-pressure gas-phase operating medium to rotate the rotor through a power-converting device and to rotate the rotor through the vanes by the expansion of a low-pressure gas-phase operating medium resulting from the drop in pressure of the high-pressure gas-phase operating medium, characterized in that a pressurized liquid-phase fluid is supplied to a static-pressure bearing on an output shaft rotated in unison with the rotor to support the output shaft in a static-pressure manner, and a portion of the pressurized liquid-phase fluid is supplied to another static-pressure bearing located radially outside the rotor through passages defined in the rotor.

With the above arrangement, the pressurized liquid-phase fluid is supplied to both of the static-pressure bearing on the output shaft rotated in unison with the rotor and the other static-pressure bearing located radially outside the rotor to support the output shaft in a floated state in a static-pressure manner. Therefore, it is possible to avoid the occurrence of the solid contact to reliably prevent the occurrence of the seizure and the wearing in the sliding portion. In addition, it is possible to further pressurize the pressurized liquid-phase fluid by a centrifugal force generated with the rotation of the rotor to effectively achieve the static-pressure supporting of the output shaft, because the pressurized liquid-phase fluid is supplied to the other static-pressure bearing through the passages defined within the rotor.

To achieve the first object, according to a second aspect and feature of the present invention, in addition to the first feature, there is provided a rotary fluid machine, wherein the other static-pressure bearing supports the vane in the static-pressure manner in a slot-shaped space defined in the rotor.

With the above arrangement, the vane can be supported effectively in the static-pressure manner in the slot-shaped space defined in the rotor to become floated by further pressurizing the pressurized liquid-phase fluid by the centrifugal force generated with the rotation of the rotor, whereby the occurrence of the seizure and the wearing can be prevented.

To achieve the first object, according to a third aspect and feature of the present invention, in addition to the first feature, there is provided a rotary fluid machine, wherein the other static-pressure bearing supports the side face of the rotor on the inner surface of the casing in the static-pressure manner.

With the above arrangement, the side face of the rotor can be supported effectively in the static-pressure manner on the inner surface of the casing to become floated by further pressurizing the pressurized liquid-phase fluid by the centrifugal force generated with the rotation of the rotor, whereby the occurrence of the seizure and the wearing can be prevented.

To achieve the first object, according to a fourth aspect and feature of the present invention, in addition to any of the first to third features, there is provided a rotary fluid machine, wherein the pressurized liquid-phase fluid is the same fluid as the gas-phase operating medium.

With the above arrangement, the pressurized liquid-phase fluid and the gas-phase operating medium are the same fluid and hence, a special pressurized liquid-phase fluid for the static-pressure bearing is not required, and moreover, it is possible to avoid an adverse influence generated by incorporating a different pressurized liquid-phase fluid into the operating medium.

To achieve the second object, according to a fifth aspect and feature of the present invention, there is provided a rotary fluid machine comprising a casing having a rotor chamber, a rotor accommodated in the rotor chamber, and a plurality of vanes supported in slot-shaped spaces defined in the rotor radially about a rotational axis of the rotor for reciprocal movement, so that the rotor is rotated through the vanes by the expansion of a high-pressure gas-phase operating medium supplied into the rotor chamber, characterized in that a static-pressure bearing is formed between the rotor and the vane, so that the vane is supported in a floated state by the static-pressure bearing.

With the above arrangement, the vane is supported in the floated state by the static-pressure bearing formed between the rotor and the vane and hence, the solid contact of the vane with the rotor can be avoided to exhibit a lubricating effect, thereby preventing the occurrence of the seizure and the wearing in the sliding portion.

To achieve the second object, according to a sixth aspect and feature of the present invention, in addition to the fifth feature, there is provided a rotary fluid machine, wherein the static-pressure bearing is formed to support the vane in the floated state by ejecting the pressurized liquid-phase fluid from the rotor onto a surface of the vane.

With the above arrangement, the pressurized liquid-phase fluid is ejected from the rotor onto the surface of the vane to support the vane in the floated state and hence, a liquid film of the pressurized liquid-phase fluid can be formed between the vane and the static-pressure bearing to reliably achieve the lubrication.

To achieve the second object, according to a seventh aspect and feature of the present invention, in addition to the fifth or sixth feature, there is provided a rotary fluid machine, wherein recesses for retaining the pressurized liquid-phase fluid are defined in the surface of each of the vanes.

With the above arrangement, the recesses for retaining the pressurized liquid-phase fluid are defined in the surface of each of the vanes to function as pressure-accumulated portions, whereby a liquid film of the pressurized liquid-phase fluid can be retained between the vane and the static-pressure bearing to reliably prevent the vane from being brought into solid contact with the rotor.

To achieve the second object, according to an eighth aspect and feature of the present invention, in addition to the sixth or seventh feature, there is provided a rotary fluid machine, wherein the pressurized liquid-phase fluid is the same fluid as the gas-phase operating medium.

With the above feature, the pressurized liquid-phase fluid for supporting the vane in the static-pressure manner is the same fluid as the gas-phase operating medium for driving the rotor and hence, it is possible not only to lubricate various sliding portions of the rotary fluid machine without need for a special lubricating oil to prevent the occurrence of the seizure and the wearing, but also to avoid an adverse influence generated due to the incorporation of a lubricating oil into the operating medium.

To achieve the third object, according to a ninth aspect and feature of the present invention, there is provided a rotary fluid machine comprising a casing having a rotor chamber, a rotor accommodated in the rotor chamber, and a plurality of vanes reciprocally movably supported in slot-shaped spaces defined in the rotor radially about a rotational axis of the rotor, so that the rotor is rotated through the vanes by the expansion of a high-pressure gas-phase operating medium supplied into the rotor chamber, characterized in that annular sealing means are disposed between side faces of the rotor and an inner surface of the casing and biased from one of the rotor and the casing toward the other, and a pressurized liquid-phase fluid is supplied between the other member and the sealing means to form a static-pressure bearing, thereby preventing the leakage of the gas-phase operating medium from the rotor chamber.

With the above arrangement, the annular sealing means disposed between each of the side faces of the rotor and the inner surface of the casing is biased from one of the rotor and the casing toward the other, and the pressurized liquid-phase fluid is supplied between the other member and the sealing means to form the static-pressure bearing. Therefore, the sliding portion of the sealing means can be lubricated for prevention of the occurrence of the seizure and the wearing, while effectively sealing, by the sealing means, the clearance between the side face of the rotor and the inner surface of the casing by the sealing means by virtue of a biasing force applied to the sealing means and a liquid film of the pressurized liquid-phase fluid formed in a seal face of the sealing means to prevent the leakage of the gas-phase operating medium. Even if the rotor is inclined with respect to the casing, the sealing means is inclined following the rotor, whereby a sealing effect can be maintained.

To achieve the third object, according to a tenth aspect and feature of the present invention, in addition to the ninth feature, there is provided a rotary fluid machine, wherein the sealing means are retained within annular grooves defined in the inner surface of the casing, so that backs of the sealing means are pushed and biased toward the side faces of the rotor by biasing means provided on bottoms of the annular grooves.

With the above arrangement, the misalignment of the sealing means can be prevented by retaining the sealing means within the annular grooves defined in the inner surface of the casing. Moreover, since the biasing means are provided on the bottoms of the annular grooves, the backs of the sealing means can be pushed by the biasing means and biased reliably toward the side faces of the rotor.

To achieve the third object, according to an eleventh aspect and feature of the present invention, in addition to the ninth or tenth feature, there is provided a rotary fluid machine, wherein the pressurized liquid-phase fluid is the same fluid as the gas-phase operating medium.

With the above feature, the pressurized liquid-phase fluid for biasing the sealing means is the same fluid as the gas-phase operating medium for driving the rotor and hence, portions between the rotor and the casing which are to be lubricated can be lubricated without need for a special lubricating oil for prevention of the seizure and the wearing, and moreover, an adverse influence generated due to the incorporation of a lubricating oil into the operating medium can be avoided.

To achieve the fourth object, according to a twelfth aspect and feature of the present invention, there is provided a rotary fluid machine comprising a casing having a rotor chamber, a rotor accommodated in the rotor chamber, a plurality of vanes reciprocally movably supported radially in the rotor, and annular sealing means disposed between side faces of the rotor and an inner surface of the casing, so that the rotor is rotated through the vanes by the expansion of a high-pressure gas-phase operating medium supplied into the rotor chamber, characterized in that the rotor chamber includes a high-pressure region where the high-pressure gas-phase operating medium is expanded, and a low-pressure region where the low-pressure gas-phase operating medium resulting from the expansion of the high-pressure gas-phase operating medium is discharged, and the sealability of the sealing means is higher in the high-pressure region than in the low-pressure region.

With the above arrangement, the sealability of the annular sealing means disposed between the side faces of the rotor and the inner surface of the casing is higher in the high-pressure region of the rotor chamber and lower in the low-pressure region. Therefore, an excessive sealability can be prevented from being provided in the low-pressure region, while ensuring a sufficient sealability in a high-pressure region to reliably prevent the leakage of the gas-phase operating medium, thereby alleviating the energy loss.

To achieve the fourth object, according to a thirteenth aspect and feature of the present invention, in addition to the twelfth feature, there is provided a rotary fluid machine, wherein biasing means are provided for biasing the sealing means from the side of the casing toward the rotor by a repulsion force, the repulsion force of the biasing means being stronger in the high-pressure region than in the low-pressure region.

With the above arrangement, the repulsion force of the biasing means for biasing the sealing means is stronger in the high-pressure region that in the low-pressure region. Therefore, in the high-pressure region, the sealing means can be biased strongly to increase the sealability, and in the low-pressure region, the sealing means can be biased weakly to decrease the sealability.

To achieve the fourth object, according to a fourteenth aspect and feature of the present invention, in addition to the twelfth feature, there is provided a rotary fluid machine, wherein the diametrical width of the sealing means is larger in the high-pressure region than in the low-pressure region.

With the above arrangement, the diametrical width of the sealing means is larger in the high-pressure region than in the low-pressure region and hence, it is possible to ensure that each of various circumferential portions of a ring seal has a rigidity as large as they are not flexed by a vapor pressure or by a load, to ensure a sealability, while alleviating the frictional resistance between the sealing means and the side faces of the rotor, and to prevent an increase in size of the entire rotor seal and the entire expander.

Water and a pressurized liquid-phase fluid in each of embodiments correspond to the liquid-phase operating medium of the present invention; vapor in each of embodiments corresponds to the gas-phase operating medium of the present invention; and pressurized liquid-phase fluid passages W14 in each of embodiments correspond to the passages of the present invention. In addition, ring seals 134 and 135 in each of embodiments correspond to the sealing means of the present invention, and pressure chambers 136 in each of embodiments correspond to the biasing means of the present invention. Further, O-rings 133 in each of embodiments correspond to the biasing means of the present invention.

BRIEF DESCRIPTION OF THE DRAWINGS

FIGS. 1 to 19 show a first embodiment of the present invention, wherein

FIG. 1 is a schematic illustration of a waste heat recovery system for an internal combustion engine;

FIG. 2 is a vertical sectional view of an expander, taken along a line 2—2 in FIG. 6;

FIG. 3 is a vertical sectional view of the expander, taken along a line 3—3 in FIG. 5;

FIG. 4 is an enlarged sectional view of portions around a rotational axis in FIG. 2;

FIG. 5 is a sectional view taken along a line 5—5 in FIG. 2;

FIG. 6 is a view taken in a line 6—6 in FIG. 2;

FIG. 7 is a diagram showing sectional shapes of a rotor chamber and a rotor;

FIG. 8 is a view taken along a line 8—8 in FIG. 6;

FIG. 9 is a view taken in the direction of an arrow 9 in FIG. 8;

FIG. 10 is a sectional view taken along a line 10—10 in FIG. 8;

FIG. 11 an enlarged view of essential portions of FIG. 5;

FIG. 12 is a view taken along a line 12—12 in FIG. 6;

FIG. 13 is a view taken in the direction of an arrow 13 in FIG. 12;

FIG. 14 is a sectional view taken along a line 14—14 in FIG. 13;

FIG. 15 is a sectional view taken along a line 15—15 in FIG. 14;

FIG. 16 is a sectional view taken along a line 16—16 in FIG. 11;

FIG. 17 is an enlarged view of portions around the rotational axis in FIG. 5;

FIG. 18 is a graph showing the relationship between the pressure PF in a slot-shaped space corresponding to the phase of the rotor and the pressure PQ in the rotor chamber; and FIG. 19 is a graph showing the relationship of the load applied to a vane with respect to the phase of the rotor.

FIGS. 20 to 21B show a second embodiment of the present invention, wherein FIG, 20 is a front view of a ring seal mounted on the casing;

FIG. 21B is a sectional view taken along a line 21B—21B in FIG. 20.

BEST MODE FOR CARRYING OUT THE INVENTION

A first embodiment of the present invention will now be described with reference to FIGS. 1 to 19.

Figure 1:
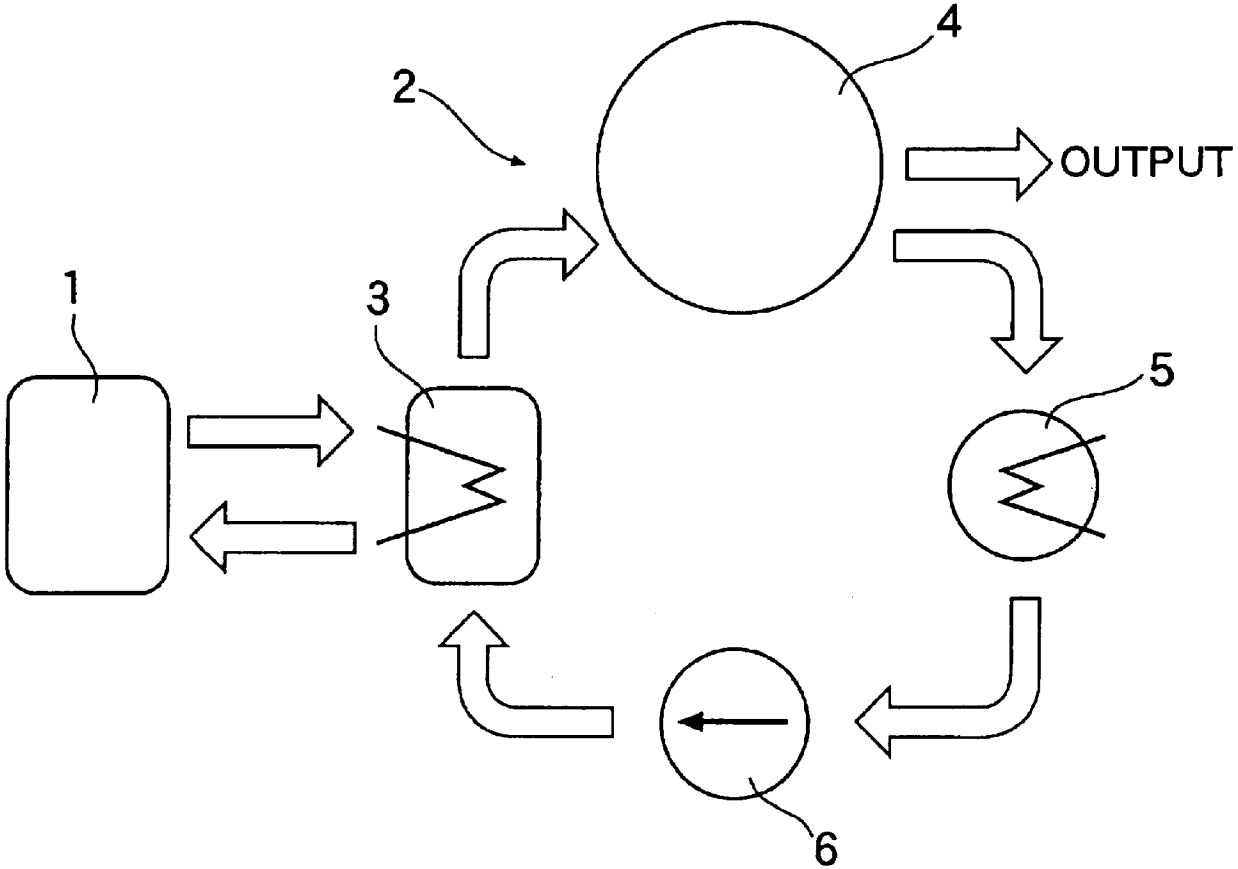

Referring to FIG. 1, a waste heat recovery system 2 for an internal combustion engine 1 includes an evaporator 3 for generating a vapor in a high-pressure state having a raised temperature, namely, a high-temperature and high-pressure vapor, from an operating medium in a high-pressure state, e.g., water, using a waste heat from an internal combustion engine 1, e.g., an exhaust gas as a heat source, an expander 4 for generating an output by the expansion of the high-temperature and high-pressure vapor, a condenser 5 for liquefying the vapor dropped in temperature and pressure discharged from the expander 4 after being expanded, namely, a dropped-temperature and dropped-pressure vapor, and a feed pump 6 for supplying water from the condenser 5 under a pressure to the evaporator 3 and static-pressure bearings which will be described hereinafter.

The expander 4 has a special structure and is constructed as described below.

Referring to FIGS. 2 to 6, a casing 7 is comprised of first and second halves 8 and 9 made of a metal. Each of the halves 8 and 9 comprises a main body 11 having a substantially elliptic recess 10, and a circular flange 12 integral with the main body 11, so that a substantially elliptic rotor chamber 14 is defined by superposing the circular flanges 12 one on another with a metal gasket 13 interposed therebetween. An outer surface of the main body 11 of the first half 8 is covered with a deep bowl-shaped main body 16 of a shell-forming member 15, and a circular flange 17 integral with the main body 16 is superposed on the circular flange 12 of the first half 8 with a gasket 18 interposed therebetween. The three circular flanges 12 and 17 are fastened together at a plurality of circumferential points by bolts 19. Thus, a junction chamber 20 is defined between the main bodies 11 and 16 of the shell-forming member 15 and the first half 8.

The main bodies 11 of the halves 8 and 9 have hollow bearing tubes 21 and 22 provided on their outer surfaces to protrude outwards, and a larger-diameter portion 24 of a hollow output shaft 23 passed through the rotor chamber 14 is rotatably supported on the hollow bearing tubes 21 and 22 with static-pressure bearings 25 interposed therebetween. Thus, an axis L of the output shaft 23 passes through an intersection between a longer diameter and a shorter diameter in the substantially elliptic rotor chamber 14. A smaller-diameter portion 26 of the output shaft 23 protrudes to the outside from a bore 27 provided in the hollow bearing tube 22 of the second half 9, and is connected with a transmitting shaft 28 through a spline-coupling 29. The smaller-diameter portion 26 and the bore 27 are sealed from each other by two seal rings 30.

A circular rotor 31 is accommodated in the rotor chamber 14. A shaft-mounting bore 32 in the center of the rotor 31 and the larger-diameter portion 24 of the output shaft 23 are a fitted relation to each other, and the rotor 31 and the larger diameter portion 24 are provided with meshed portions 33. Thus, a rotational axis of the rotor 31 is matched with the axis L of the output shaft 23 and hence, is also designated by L commonly used as a reference character.

A plurality of, e.g., twelve (in this embodiment) slot-shaped spaces 34 are defined at circumferentially equal distances in the rotor 31 to extend radially from the shaft-mounting bore 32 about the rotational axis L. Each of the spaces 34 is formed into a substantially U-shape in a phantom plane perpendicular to opposite side faces 35 of the rotor 31, so that it has a small circumferential width and sequentially opens into the opposite side faces 35 and an outer peripheral surface 36 of the rotor 31.

Figure 11:
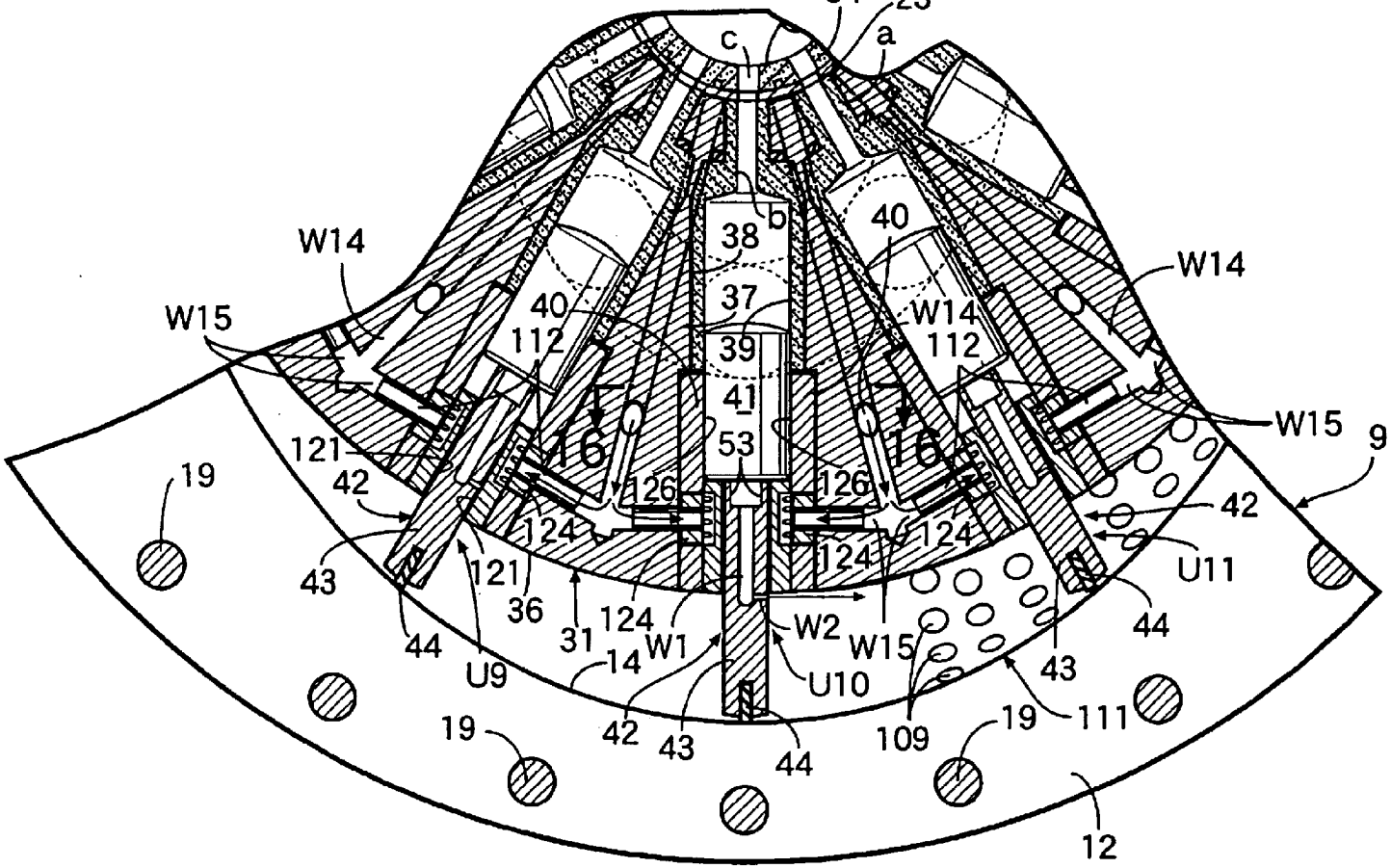
Figure 12:
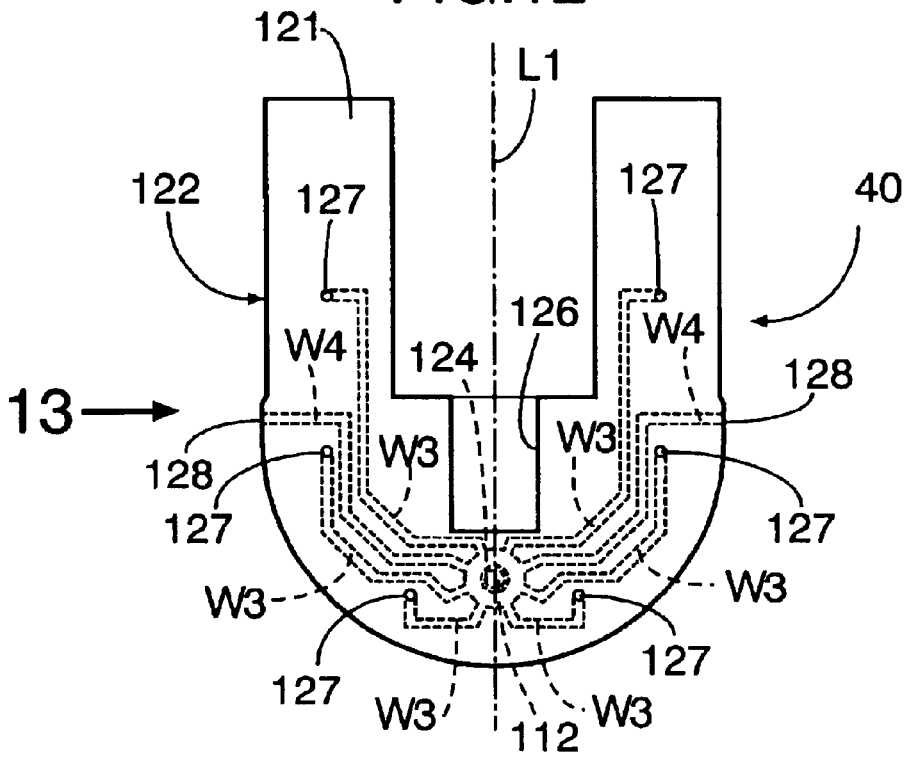
Figure 13:
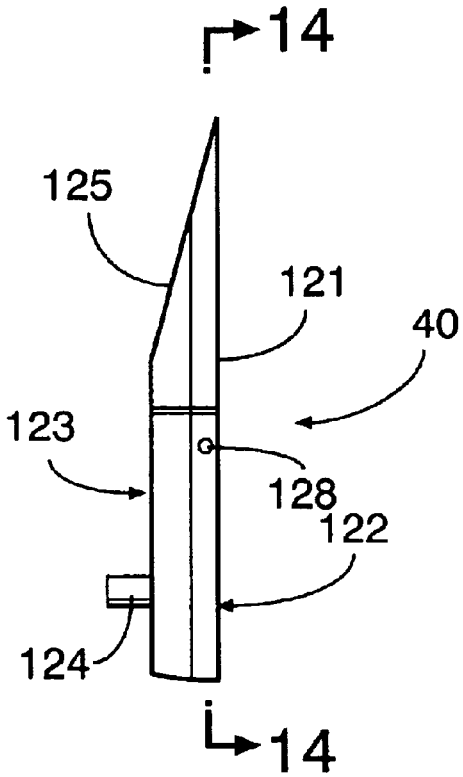
Figure 14:
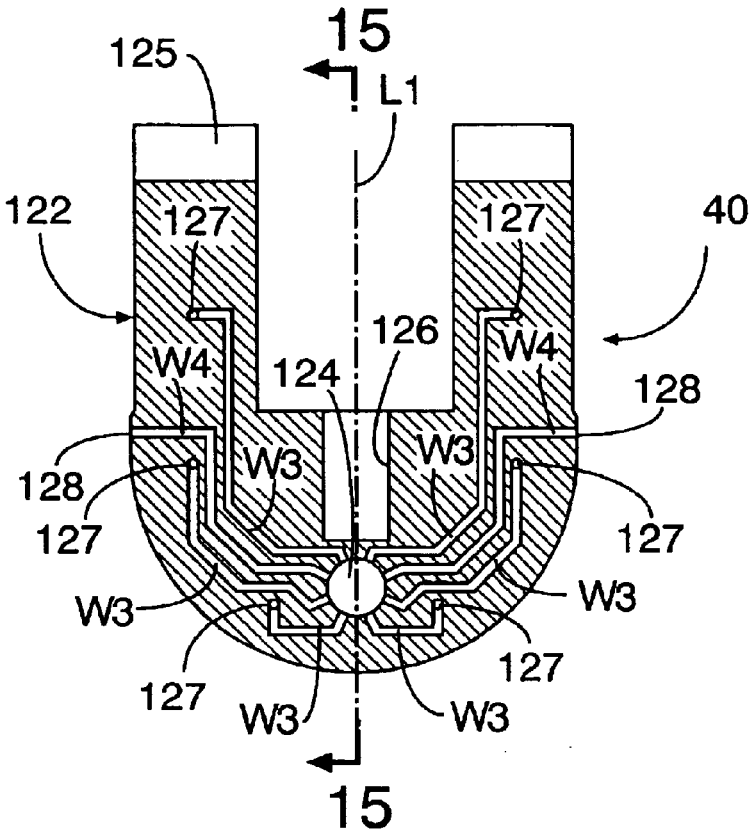
Figure 15:
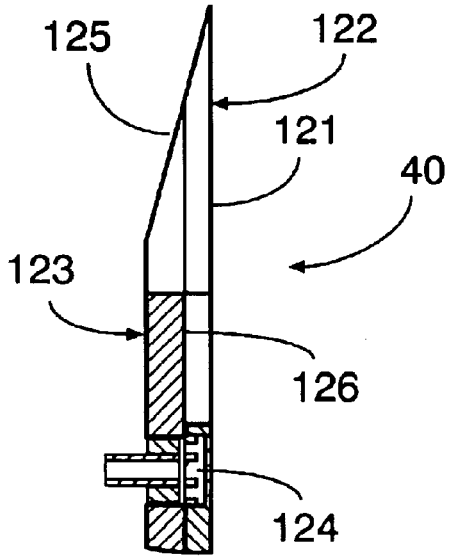
Figure 16:
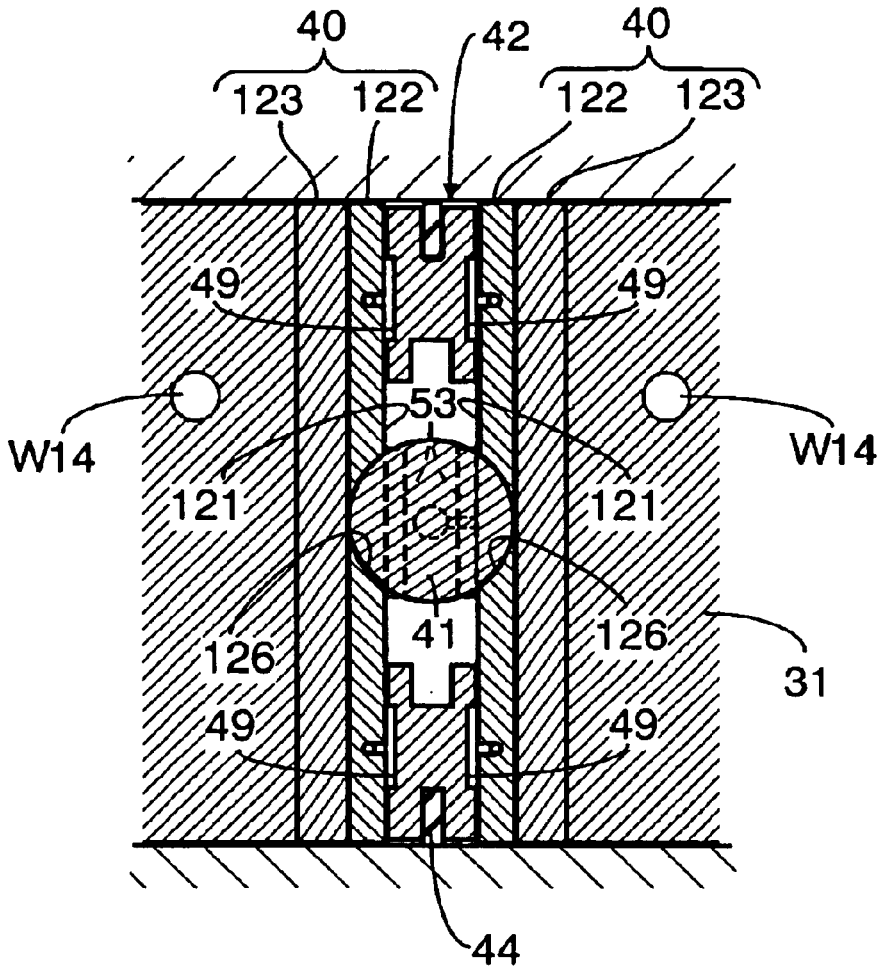

As best shown in FIGS. 11 and 16, first to twelfth vane piston units U1 to U12 having the same structure are mounted in the slot-shaped spaces 34 (see FIG. 4) for reciprocal movement in a radial direction, as described below. In each of the slot-shaped spaces 34 having the substantially U-shape, a stepped bore 38 is defined in a portion 37 defining an inner periphery of the slot-shaped space 34, and a stepped cylinder member 39 made of a ceramic (or carbon) is fitted into the stepped bore 38. An end face of a smaller-diameter portion a formed at a radially inner location on the cylinder member 39 abuts against an outer peripheral surface of the larger-diameter portion 24 of the output shaft 23, and a smaller-diameter bore b made radially through the inside of the smaller-diameter portion a communicates with a through-bore c which opens into the outer peripheral surface of the larger-diameter portion 24 (see FIG. 4). A pair of side plates 40 are disposed outside the cylinder member 39 and formed in a surface-symmetry relation to each other, so that they are located coaxially with the cylinder member 39. The pair of side plates 40 opposed to each other are disposed radially outside the cylinder member 39 and have axes matched with the axis of the cylinder member 39. A piston 41 made of a ceramic is radially movably guided by the cylinder member 39 and the pair of side plates 40 opposed to each other, and each of the first to twelfth vane piston units U1 to U12 is radially movably guided in the slot-shaped space 34 defined between the pair of side plates 40 opposed to each other.

Figure 2:
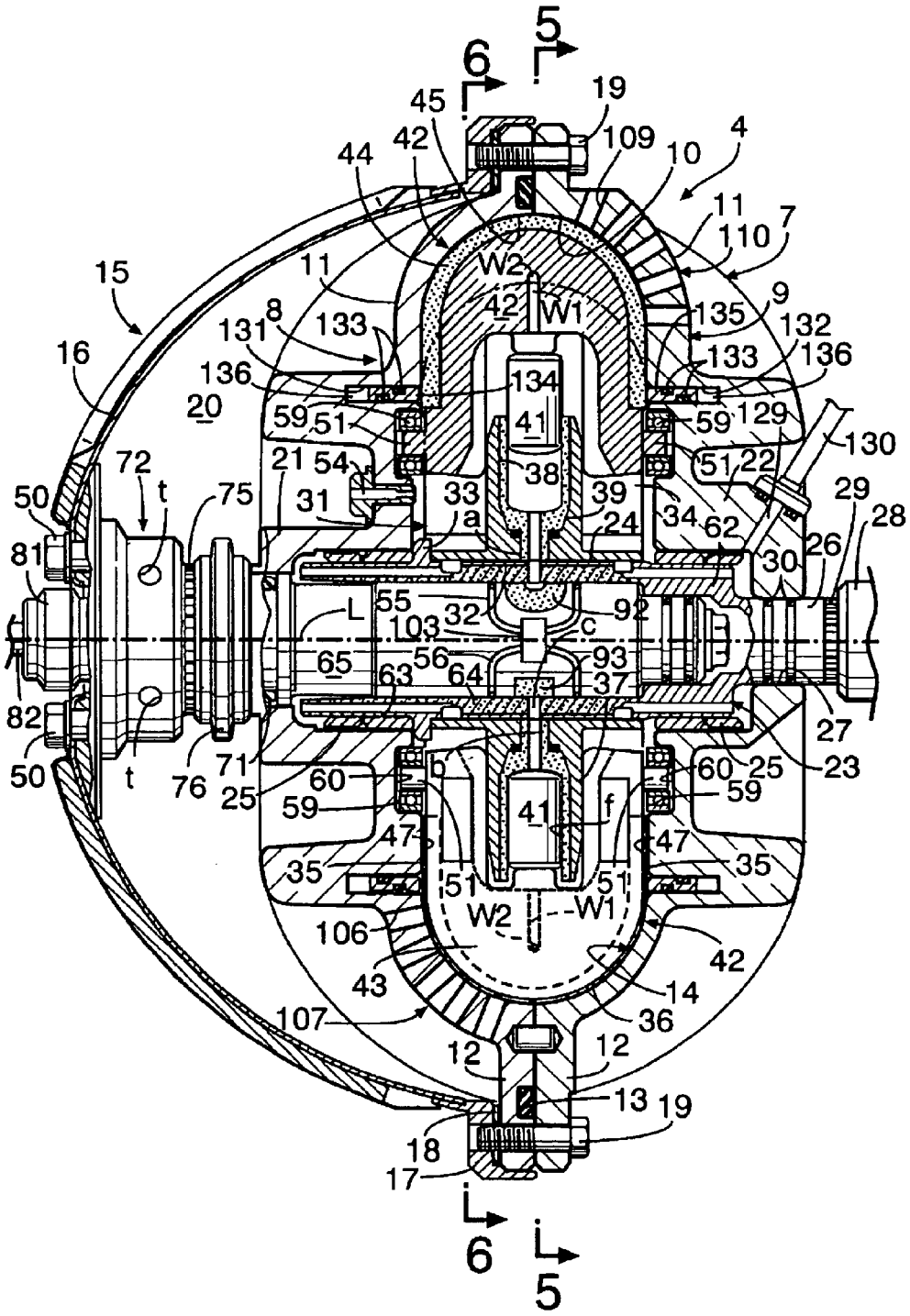
Figure 7:
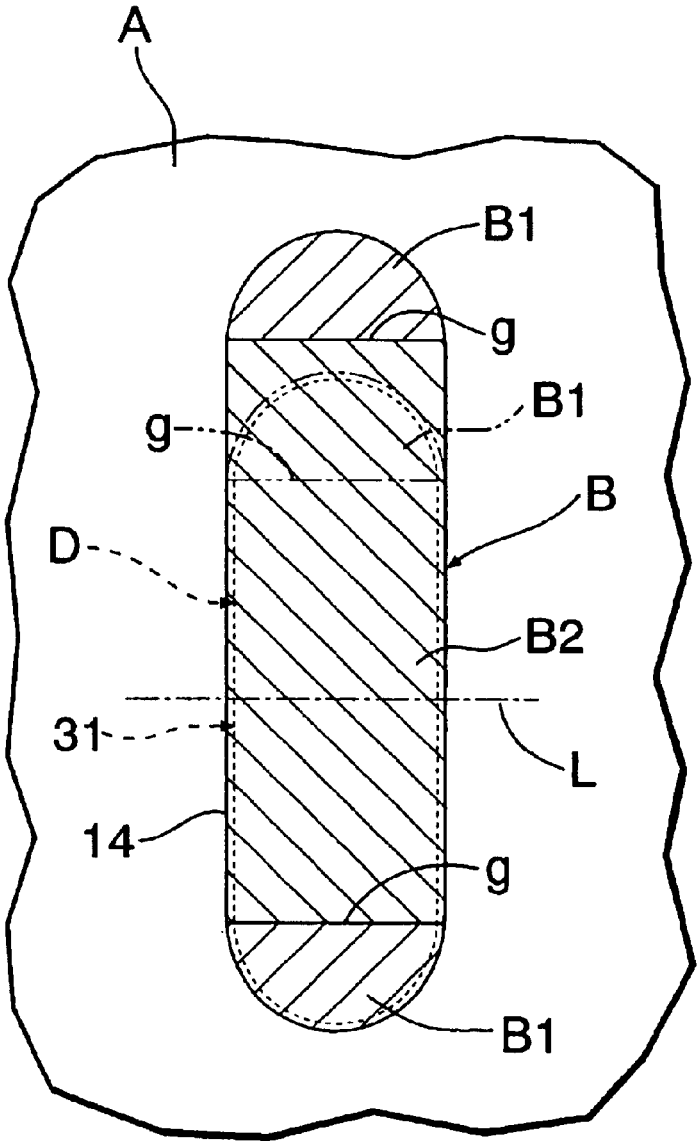

As shown in FIGS. 2 and 7, a section B of the rotor chamber 14 within a phantom plane A including the rotational axis L of the rotor 31 comprises a pair of semi-circular section portions B1 with their diameters g opposed to each other, and a quadrilateral section portion B2 formed to connect opposed ends of one of the diameters g of the semi-circular section portions B1 to each other and to connect opposed ends of the other diameter g of the semi-circular section portions B1 to each other. In this way, the section B of the rotor chamber 14 assumes a substantially competition truck-shape. In FIG. 7, a portion shown by a solid line indicates the largest section including a longer diameter, while a portion partially shown by a two-point dashed line indicates the smallest section including the shorter diameter. The rotor 31 has a section D slightly smaller than the smallest section including the shorter diameter of the rotor chamber 14, as shown by a dotted line in FIG. 7.

As clearly shown in FIGS. 2 and 8 to 10, a vane 42 is comprised of a vane body 43 of a substantially U-shaped plate form (a horseshoe shape), and a seal member 44 (see FIG. 2) of a substantially U-shaped plate form mounted on the vane body 43.

The vane body 43 is a plate-shaped member having a constant thickness and includes a semi-arcuate portion 46 corresponding to an inner peripheral surface 45 formed by the semi-circular section portion B1 of the rotor chamber 14, and a pair of parallel portions 48 corresponding to opposed inner end faces 47 formed by the quadrilateral section portions B2. The seal member 44 formed of PTFE, for example, is fitted into and retained in a U-shaped groove 52 which extends from one of the opposed inner end faces 47 via the semi-arcuate portion 46 to the other opposed inner end face 47 and opens outwards of the vane body 43. A pair of short shafts 51 are provided at ends of the parallel portions 48 to protrude laterally outwards, and rollers 59 each having a ball bearing structure are mounted on the short shafts 51, respectively. A total of four quadrilateral shallow recesses 49 (which are quadrilateral in the embodiment, but may be of any shape) each having a predetermined area for retaining a pressurized liquid-phase fluid (pressurized water in the embodiment) to be supplied to the static-pressure bearings are defined in a surface and a back of the vane body 43, so that they adjoin the short shafts 51, respectively.

Figure 8:
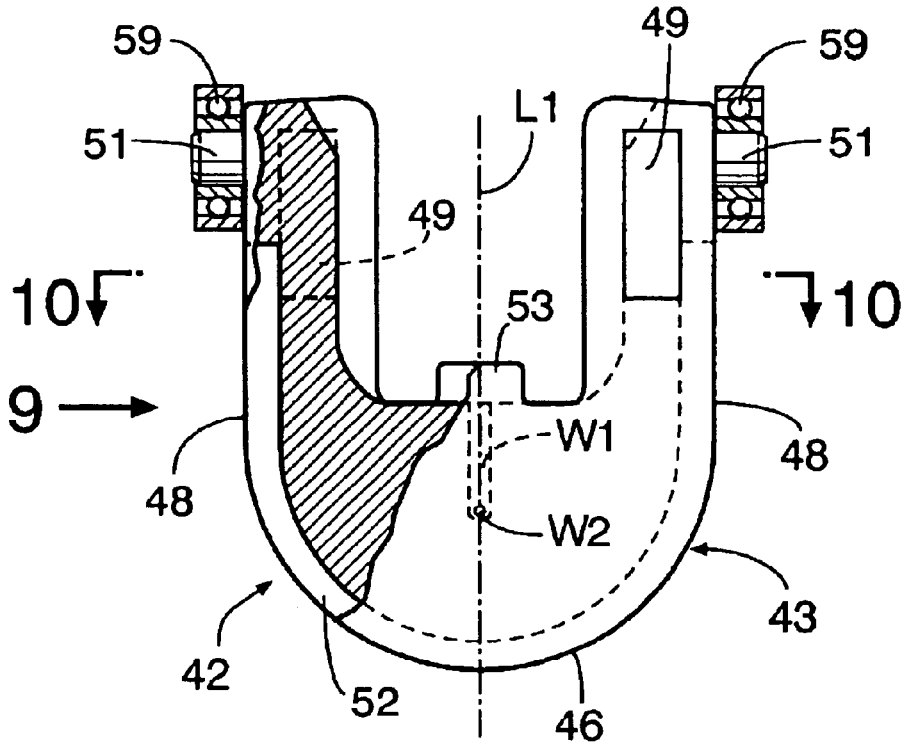
Figure 9:
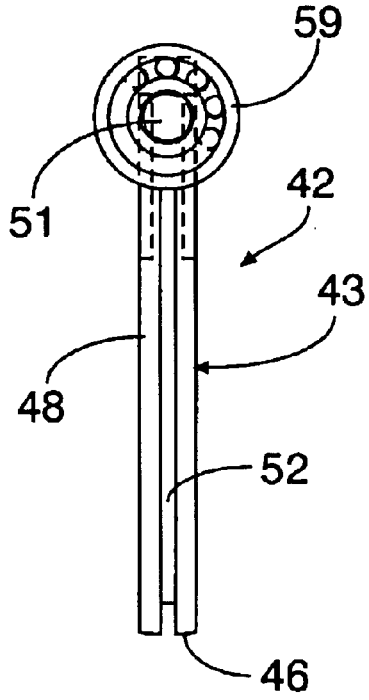
Figure 10:
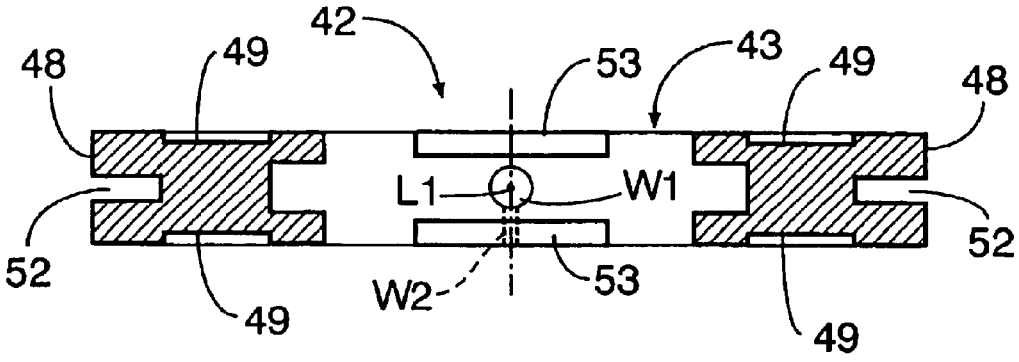

An axis L1 in FIG. 8 is an axis of the cylinder member 39 and the piston 41, and a pair of plate-shaped projections 53 are mounted on the axis L1, so that a radially outer end of the piston 41 abuts against the plate-shaped projections 53. A blind pressurized liquid-phase fluid passage W1 is defined to extend from between the pair of plate-shaped projections 53 along the axis L1 into the vane body 43, and a pressurized liquid-phase fluid passage W2 bent at a right angle from a tip end of the pressurized liquid-phase fluid passage W1 opens into one side face of the vane body 43.

The structure of the side plate 40 will be described below with reference to FIGS. 11 to 16.

The side plate 40 includes an inner member 122 having a U-shaped contour similar to that of the vane body 43 and having a vane slide face 121 with which the vane body 43 is in sliding contact, an outer member 123 laminated on the inner member 122 and retained on the rotor 31, and an orifice-defining member 124 supported between both of the members 122 and 123 radially outside the rotor 31 and protruding on an outer surface of the outer member 123. The side plate 40 corresponding to the radially inner side of the rotor 31 has an inclined face 125 tapered with respect to the vane slide face 121, so that the mounting of the rotor 31 in the radially inner narrow space is facilitated by the inclined face 125. The inner member 122 of the side plate 40 has a partially cylindrical piston guide portion 126 leading to the vane slide face 121, and the piston 41 moved radially outwards from the cylinder member 39 is accommodated in a non-contact state within the piston guide portions 126 of the pair of side plates 40 (see FIGS. 11 and 16).

A total of eight pressurized liquid-phase fluid passages W3 and W4 are provided in a mating face of the inner member 122 on the outer member 123 to extend radially from the orifice-defining member 124. Each of tip ends of six W3 of the pressurized liquid-phase fluid passages opens as a pressurized liquid-phase fluid discharge bore 127 into the vane slide face 121 of the inner member 122, and each of the remaining two pressurized liquid-phase fluid passages W4 opens as a pressurized liquid-phase fluid discharge bore 128 into an outer surface of the inner member 122 (see FIG. 12). The orifice-defining member 124 exhibits an orifice function for the eight pressurized liquid-phase fluid passages W3 and W4.

Each of the vanes 42 is slidably received in each of the slot-shaped space 34 of the rotor 31. In this case, the opposite side faces of the vane body 43 are sandwiched between the vane slide faces 121 of the pair of the side plates 40 opposed to each other, so that they are slid radially. At this time, inner end faces of the pair of projections 53 of the vane 42 can be put into abutment against an outer end face of the piston 41. Both of the rollers 59 provided on the vane 42 are rollably engaged in substantially elliptic annular grooves 60 defined in the opposed inner end faces 47 of the first and second halves 8 and 9. A distance between the annular grooves 60 and the rotor chamber 14 is constant over the entire periphery. The advancing movement of the piston 41 is converted into the rotational movement of the rotor 31 by the engagement of the rollers 59 and the annular grooves 60 through the vane 42.

Figure 6:
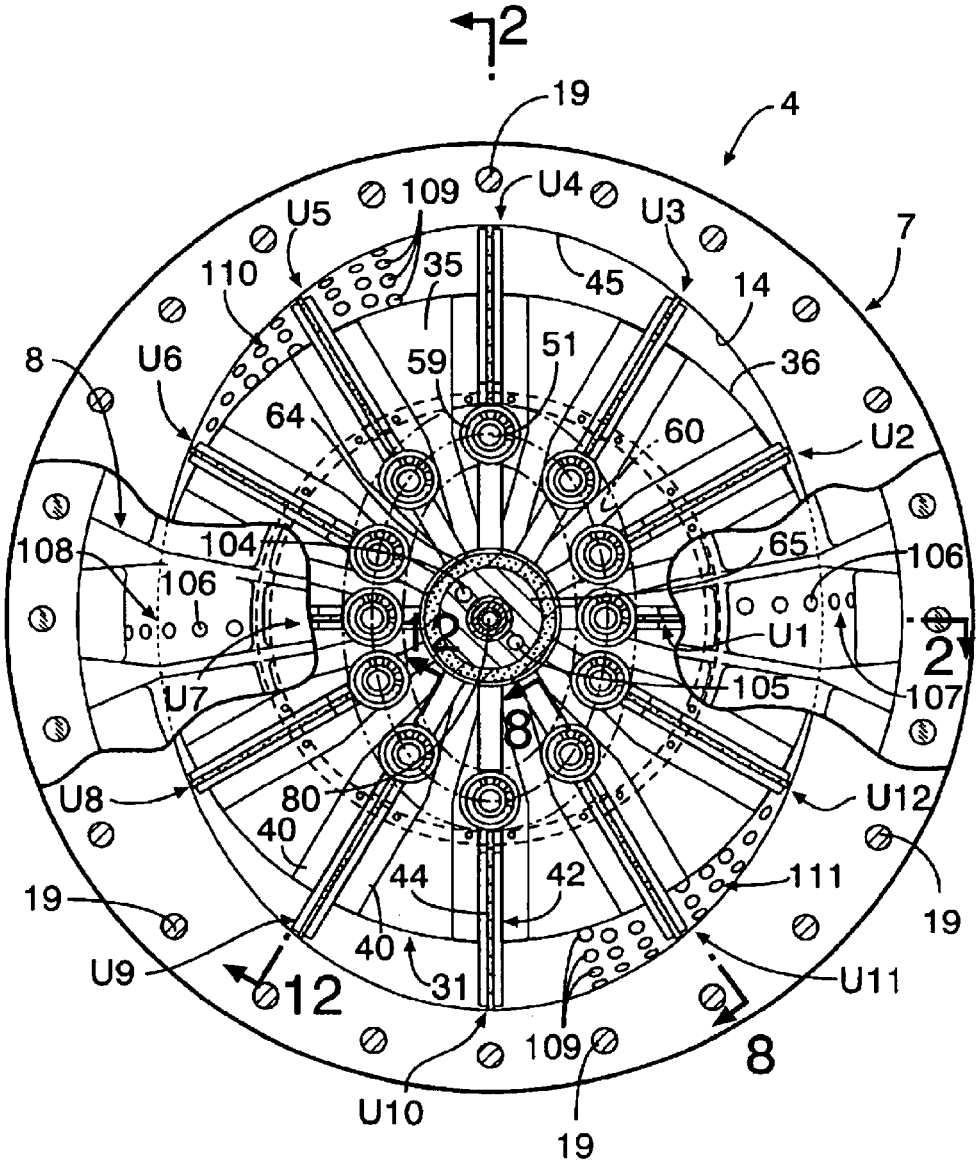

The cooperation of the roller 59 and the annular groove 60 ensures that a semi-arcuate tip end face 61 of the semi-arcuate portion 46 of the vane body 43 is normally spaced apart from the inner peripheral surface 45 of the rotor chamber 14, and both of the parallel portions 48 are normally spaced apart from the opposed inner end faces 47 of the rotor chamber 14, as clearly shown in FIG. 6, whereby the friction loss is alleviated. Orbits are restrained by a pair of the two annular grooves 60 and hence, the vane 42 produces a rotation of a very small displacement angle in an axial direction through the rollers 59 due to an error between the left and right orbits, whereby the pressure of contact of the vane with the inner peripheral surface 45 of the rotor chamber 14 is increased. In this case, the amount of the vane displaced can be decreased remarkably, because the diametrical length of a portion of the vane body 43 of the substantially U-shaped plate form (the horseshoe shape), which contacts with the casing 7, is short as compared with a rectangular (oblong) vane. In addition, as clearly shown in FIG. 2, the seal member 44 mounted on the vane body 43 is in close contact with the inner peripheral surface of the rotor chamber 14 to perform a sealing. In this case, the close contact is good, because the vane 42 of the substantially U-shaped plate form has no inflection point, as compared with the rectangular (oblong) vane.

It should be noted here that the sealing between the vane body 43 and the inner peripheral surface of the rotor chamber 14 is produced by a spring force of the seal member 44 itself made of an elastomeric material, a centrifugal force applied to the seal member 44 itself and a vapor pressure of the vapor flowing from the high-pressure rotor chamber 14 into the U-shaped groove 52 in the vane body 43 for pushing the seal member 44 upwards. In this way, the sealing is not influenced by an excessive centrifugal force applied to the vane body 43 in accordance with the rotational speed of the rotor 31 and hence, the sealing surface pressure does not rely on the centrifugal force applied to the vane body 43, and both of a good sealability and a low-friction property can be always reconciled.

Figure 4:
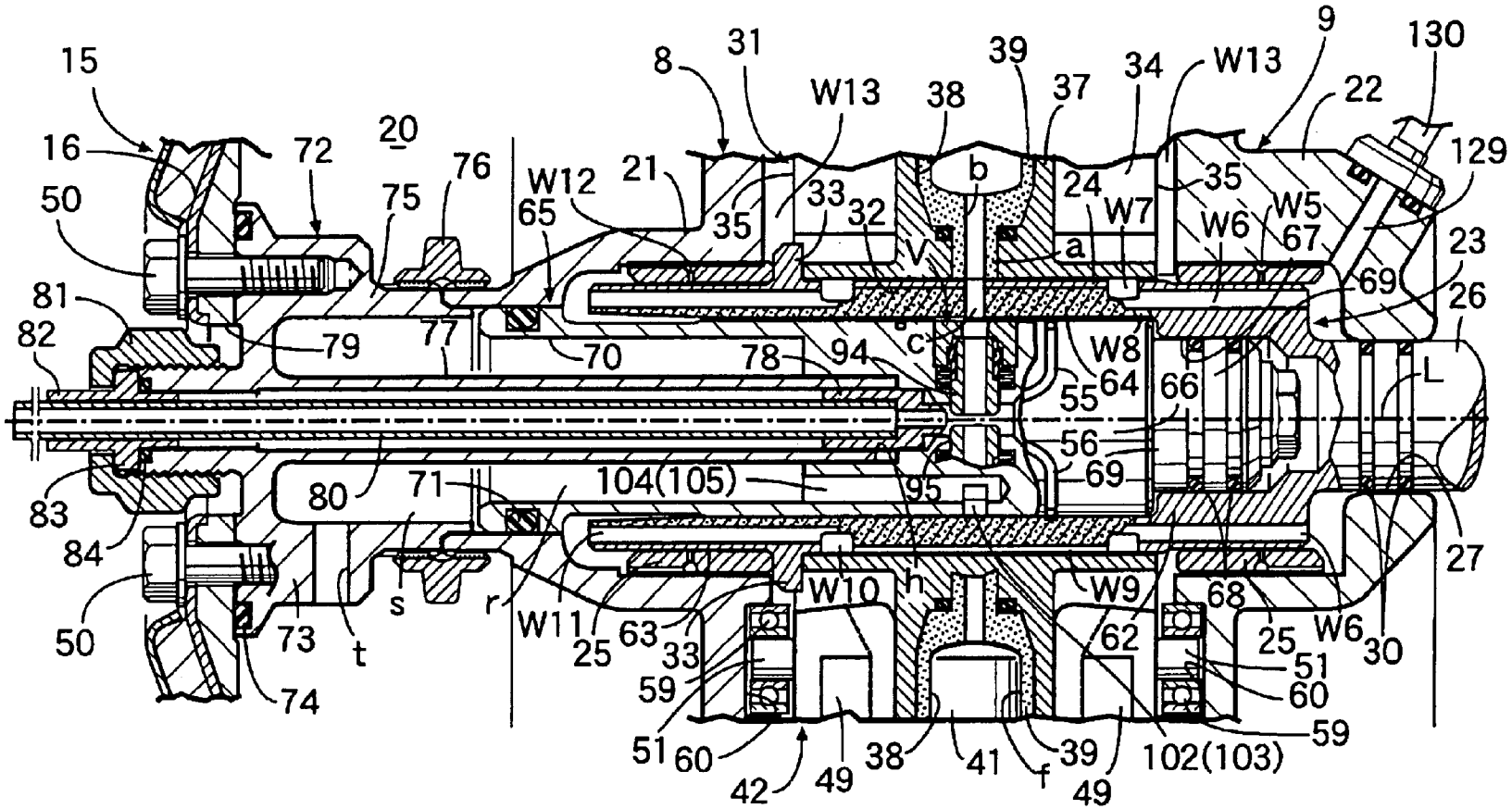

Referring to FIGS. 2 and 4, the larger-diameter portion 24 of the output shaft 23 includes a thicker portion 62 supported on the static-pressure bearings 25 of the second half 9, and a thinner portion 63 extending from the thicker portion 62 and supported on the static-pressure bearings 25 of the first half 8. A hollow shaft 64 made of a ceramic (or a metal) is fitted in the thinner portion 63, so that it can be rotated in unison with the output shaft 23. A stationary shaft 65 is disposed inside the hollow shaft 64 and comprises a larger-diameter solid portion 66 fitted in the hollow shaft 64, so that it exists within an axial thickness of the rotor 31, and a smaller-diameter solid portion 69 fitted in a bore 67 existing in the thicker portion 62 of the output shaft 23 with two seal rings 68 interposed therebetween, and a thin-wall hollow portion 70 extending from the larger-diameter solid portion 66 and fitted in the hollow shaft 64. A seal ring 71 is interposed between an outer peripheral surface of an end of the hollow portion 70 and an inner peripheral surface of the hollow bearing tube 21 of the first half 8.

In the main body 16 of the shell-forming member 15, an end wall 73 of a hollow tube 72 existing coaxially with the output shaft 23 is mounted to the inner surface of the central portion of the main body 16 by a plurality of bolts 50 with a seal ring 74 interposed therebetween. An inner end of a short outer tube portion 75 extending inwards from an outer periphery of the end wall 73 is connected to the hollow bearing tube 21 of the first half 8 through a connecting tube 76. A smaller-diameter and long inner pipe portion 77 is provided on the end wall 73 to extend through the end wall 73, and has an inner end fitted in a stepped bore h existing in the larger-diameter solid portion 66 of the stationary shaft 65 along with a short hollow connecting pipe 78 protruding from such inner end. An outer end of the inner pipe portion 77 protrudes outwards from a bore 79 in the shell-forming member 15, and an inner end of a first high-temperature and high-pressure vapor-introducing pipe 80 inserted from such outer end through the inner pipe portion 77 is fitted in the hollow connecting pipe 78. A cap member 81 is threadedly fitted over the outer end of the inner pipe portion 77, and a flange 83 of a tubular holder 82 for retaining the introducing pipe 80 is put into pressure contact with the outer end face of the inner pipe portion 77 withy a seal ring 84 interposed therebetween by the cap member 81.

As shown in FIGS. 2 to 4 and 11, a rotary valve V is mounted in the larger-diameter solid portion 66 of the stationary shaft 65 in the following manner for supplying the high-temperature and high-pressure vapor to the cylinder members 39 of the first to twelfth vane piston units U1 to U12 through the plurality of, e.g., twelve (in the embodiment) through-bores c defined in series in the hollow shaft 64 and the output shaft 23 and discharging a first dropped-temperature and dropped-pressure vapor, after expansion, from the cylinder members 39 through the through-bores c.

Figure 17:
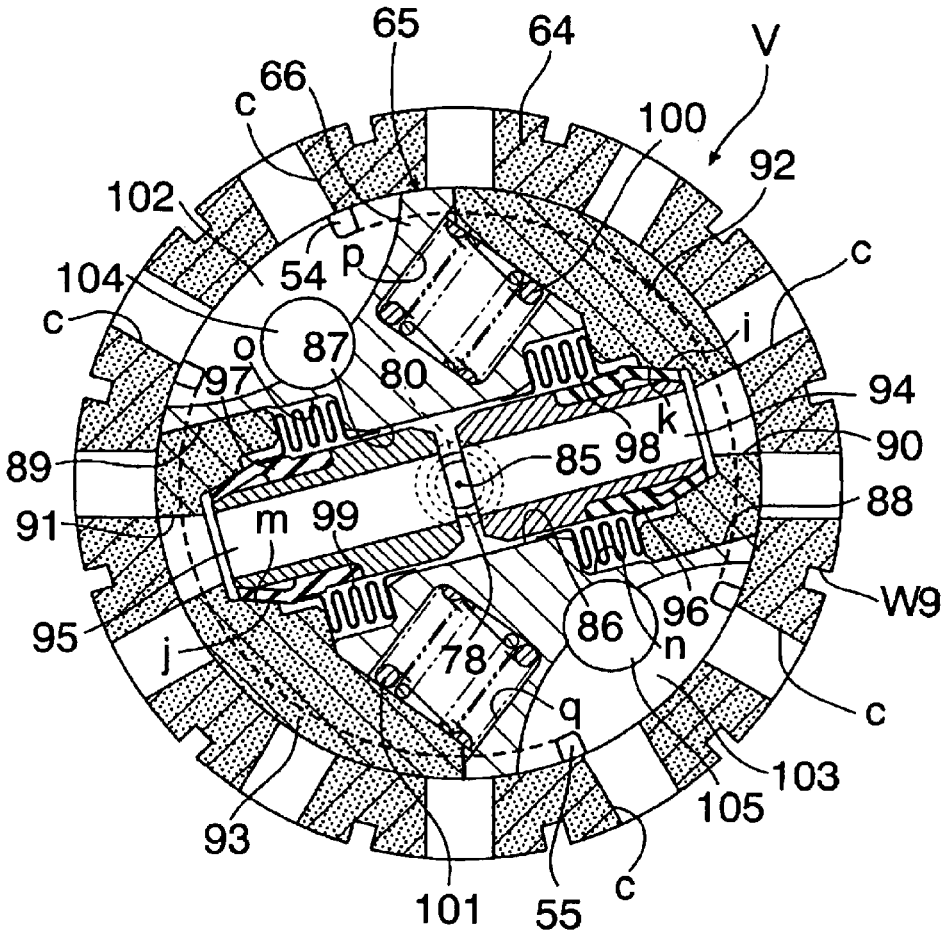

The structure of the rotary valve V for supplying and discharging the vapor with a predetermined timing to and from the cylinder members 39 of the expander 4 is shown in FIG. 17. First and second bores 86 and 87 are defined in the larger-diameter solid portion 66 to extend in opposite directions from a space 85 communicating with the hollow connecting pipe 78, and open into bottom surfaces of first and second recesses 88 and 89 which open into the outer peripheral surface of the larger-diameter solid portion 66. First and second seal blocks 92 and 93 made of carbon and having feed ports 90 and 91 are mounted in the first and second recesses 88 and 89, respectively with their outer peripheral surfaces being in sliding contact with an inner peripheral surface of the hollow shaft 64. First and second coaxial short feed pipes 94 and 95 are loosely inserted into the first and second bores 86 and 87, and tapered outer peripheral surfaces i and j of first and second seal tube 96 and 97 fitted over outer peripheral surfaces of tip ends of the first and second feed pipes 94 and 95 are fitted to inner peripheral surfaces of tapered bores k and m provided inside the feed ports 90 and 91 of the first and second seal blocks 92 and 93 and leading to the feed ports 90 and 91. First and second annular recesses n and o surrounding the first and second feed pipes 94 and 95 and first and second blind recesses p and q adjoining the first and second annular recesses n and o are defined in the larger-diameter solid portion 66, so that they face to the first and second seal blocks 92 and 93. First and second bellows-shaped elastomers 98 and 99 are received in the first and second annular recesses n and o, respectively and each have one end fitted over each of the outer peripheral surfaces of the first and second seal tubes 96 and 97, and first and second coil springs 100 and 101 are received in the first and second blind recesses p and q, respectively, so that the first and second seal blocks 92 and 93 are pushed against the inner peripheral surface of the hollow shaft 64 by the repulsion forces of the first and second bellows-shaped elastomers 98 and 99 and the first and second coil springs 100 and 101.

In the larger-diameter solid portion 66, first and second recess-shaped discharge portions 102 and 103 and first and second discharge bores 104 and 105 are defined between the first coil spring 100 and the second bellows-shaped elastomer 99 and between the second coil spring 101 and the first bellows-shaped elastomer 98, so that the discharge portions 102 and 103 normally communicate with the two through-bores c, and the first and second discharge bores 104 and 105 extend in parallel to the introducing pipe 80 from the discharge portions 102 and 103 and open into a hollow r in the stationary shaft 65.

Any members, which are of the same type and prefixed by "first" and by "second", respectively, as are the first seal block 92 and the second seal block 93, are in a relation of point symmetry to each other with respect to the axis of the stationary shaft 65.

The inside of the hollow r of the stationary shaft 65 and the inside of the outer tube portion 75 of the hollow tube 72 are passages s for the first dropped-temperature and dropped-pressure vapor, which communicate with the junction chamber 20 through a plurality of through-bores t made through a peripheral wall of the outer tube portion 75.

As shown in FIGS. 2 and 6, first and second introducing bore groups 107 and 108 each comprising a plurality of introducing bores 106 arranged radially are defined in the outer peripheral portion of the main body 11 of the first half 8 in the vicinity of opposite ends of the shorter diameter of the rotor chamber 14, so that the first dropped-temperature and dropped-pressure vapor is introduced from the junction chamber 20 via the introducing bore groups 107 and 108 into the rotor chamber 14. A first discharge bore group 110 comprising a plurality of discharge bores 109 arranged radially and circumferentially is defined in the outer peripheral portion of the main body 11 of the second half 9 between one end of the longer diameter of the rotor chamber 14 and the second introducing bore group 108, and a second discharge bore group 111 comprising a plurality of discharge bores 109 arranged radially and circumferentially is defined in the outer peripheral portion of the main body 11 of the second half 9 between the other end of the longer diameter and the first introducing bore group 107. A second dropped-temperature and dropped-pressure vapor further dropped in temperature and pressure by the expansion between the adjacent vanes 42 is discharged to the outside from the first and second discharge bore groups 110 and 111.

Figure 5:
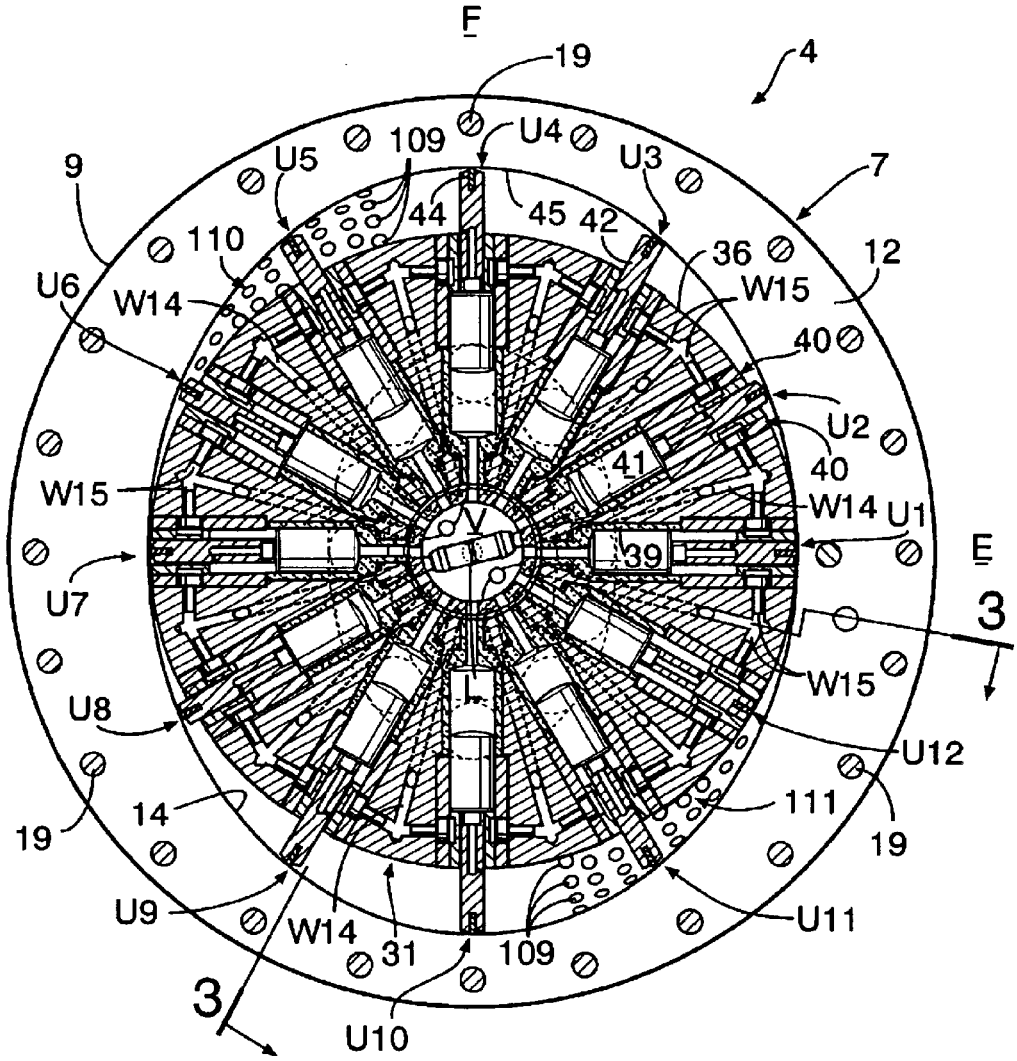

Referring to FIG. 5, the first and seventh vane piston units U1 and U7 in a relation of point symmetry to each other with respect to the rotational axis L of the rotor 31 perform similar motions. This also applies to the second and eighth vane piston units U2 and U8 in a relation of point symmetry to each other and the like.

Referring also to FIG. 17, for example, it is supposed that an axis of the first feed pipe 94 is slightly deviated in a counterclockwise direction as viewed in FIG. 5 from a position E of the shorter diameter of the rotor chamber 14, and the first vane piston unit U1 is in the position E of the shorter diameter, so that the high-temperature and high-pressure vapor is not supplied to the larger-diameter cylinder bore f in the first vane piston unit U1, and hence, the piston 41 and the vane 42 are in their retracted positions.

When the rotor 31 is slightly rotated from this state in the counterclockwise direction as viewed in FIG. 5, the feed port 90 in the first seal block 92 and the through-bore c communicate with each other, thereby permitting the high-temperature and high-pressure vapor from the introducing pipe 80 to be introduced through the smaller-diameter bore b into the larger-diameter cylinder bore f. This causes the piston 41 to be advanced, and the advancing movement is converted into the rotational movement of the rotor 31 through the vane 42 by the engagement of the roller 59 integral with the vane 42 in the annular groove 60 due to the sliding movement of the vane 42 toward the position F of the longer diameter of the rotor chamber 14. When the through-bore c is deviated from the feed port 90, the high-temperature and high-pressure vapor is expanded in the larger-diameter cylinder bore f to further advance the piston 41, thereby continuing the rotation of the rotor 31. The expansion of the high-temperature and high-pressure vapor is completed when the first vane piston unit U1 has reached the position F of the longer diameter of the rotor chamber 14. Thereafter, with the rotation of the rotor 31, the first dropped-temperature and dropped-pressure vapor in the larger-diameter cylinder bore f is discharged into the junction chamber 20 via the smaller-diameter bore b, the through-bore c, the first recess-shaped discharge portion 102, the first discharge bore 104, the passage s (see FIG. 4) and the through-bore t by the retraction of the piston 41 conducted by the vane 42; then introduced through the first introducing bore group 107 into the rotor chamber 14i as shown in FIGS. 2 and 6; and further expanded between the adjacent vanes 42 to rotate the rotor 31. Thereafter, the second dropped-temperature and dropped-pressure vapor is discharged to the outside from the first discharge bore group 110.

In this manner, the piston 41 is operated by the expansion of the high-temperature and high-pressure vapor to rotate rotor 31 through the vane 42, and the rotor 31 is rotated through the vane 42 by the expansion of the dropped-temperature and dropper-pressure vapor produced by the dropping of the pressure of the high-temperature and high-pressure vapor, whereby an output is provided from the output shaft 23.

An arrangement for converting the advancing movement of the piston 41 into the rotational movement of the rotor 31 may be provided in addition to that in the embodiment. In this case, the advancing movement of the piston 41 can be received directly on the rollers 59, not through the vane 42, and converted into the rotational movement of the rotor 31 by the engagement of the rollers 59 in the annular grooves 60. The vane 42 may be normally spaced at a substantially constant distance apart from the inner peripheral surface 45 of the rotor chamber 14 and the opposed inner end faces 47 by cooperation of the rollers 59 and the annular grooves 60 with each other, as described above, and the piston 41 and the roller 59, as well as the vane 42 and the roller 59 may cooperate especially with the annular groove 60.

When the expander 4 is used as a compressor, the rotor 31 is rotated in a clockwise direction as viewed in FIG. 5 by the output shaft 23, whereby the open air as a fluid is drawn from the first and second discharge bore groups 110 and 111 into the rotor chamber 14 by the vanes 42. The lowly-compressed air produced in this manner is supplied from the first and second introducing bore groups 107 and 108 via the junction chamber 20, the through-bores t, the passages s, the first and second discharge bores 104 and 105, the first and second recess-shaped discharge portions 102 and 103 and the through-bores c into the larger-diameter cylinder bores f, and the pistons 41 are operated by the vanes 42 to convert the low-pressure air into the high-pressure air, which is introduced via the through-bores c, the feed ports 90 and 91 and the first and second feed pipes 94 and 95 into the introducing pipe 80.

The lubrication of various sliding portions of the expander 4 conducted by the static-pressure bearings using the pressurized liquid-phase fluid as a medium will be described below.

As shown in FIG. 4, a pressurized liquid-phase fluid feed pipe 130 is connected to a pressurized liquid-phase fluid feed bore 129 defined in the hollow bearing tube 20 of the second half 9. The supplying of the pressurized liquid-phase fluid to the pressurized liquid-phase fluid feed pipe 130 is carried out by the feed pump 6 (see FIG. 1) for supplying the water from the condenser 5 to the evaporator 3 under a pressure. A special feed pump for supplying the pressurized liquid-phase fluid is not required by utilizing the feed pump 6 for supplying the pressurized liquid-phase fluid to the static-pressure bearings at various portions of the expander 4, leading to a reduction in number of parts.

The pressurized liquid-phase fluid having a high-pressure and supplied from the pressurized liquid-phase fluid feed bore 129 flows through a pressurized liquid-phase fluid passage W5 defined in the static-pressure bearing 25 in the second half 9 and reaches the sliding portions of the inner peripheral surface of the static-pressure bearing 25 and the outer peripheral surface of the larger-diameter portion 24 of the output shaft 23. The outer peripheral surface of the output shaft 23 is supported in a floated state by a liquid film formed at the sliding portions, whereby the solid contact between the output shaft 23 and the static-pressure bearing 25 can be prevented, and the lubrication is achieved so as to prevent the seizure and wearing from occurring. The pressurized liquid-phase fluid feed bore 129 communicates with an annular pressurized liquid-phase fluid passage W7 defined around the outer periphery of the larger-diameter portion 24 of the output shaft 23 and a plurality of pressurized liquid-phase fluid passages W8 defined around the inner periphery of the larger-diameter portion 24 of the output shaft 23 through a plurality of pressurized liquid-phase fluid passages W6 provided axially in the larger-diameter portion 24 of the output shaft 23. The pressurized liquid-phase fluid passed through the pressurized liquid-phase fluid passages W8 lubricates the sliding portions of the outer peripheral surface of the larger-diameter solid portion 66 of the stationary shaft 65 and the inner peripheral surface of the hollow shaft 64 as well as the sliding portions of the outer peripheral surface of the smaller-diameter solid portion 69 of the stationary shaft 65 and the inner peripheral surface of the bore 67 in the output shaft 23.

The annular pressurized liquid-phase fluid passage W7 communicates with an annular pressurized liquid-phase fluid passage W10 defined symmetrically on the side of the rotor 31 opposite from the annular pressurized liquid-phase fluid passage W7 through a plurality of pressurized liquid-phase fluid passages W9 (see FIG. 17) defined around the outer periphery of the hollow shaft 64. The pressurized liquid-phase fluid from the annular pressurized liquid-phase fluid passage W10 is supplied to a pressurized liquid-phase fluid passage W11 defined between the larger-diameter portion 24 of the output shaft 23 and the hollow shaft 64, and flows through a pressurized liquid-phase fluid passage W12 defined in the static-pressure bearing 25 of the first half 8 and reaches the sliding portions of the inner peripheral surface of the static-pressure bearing 25 and the outer peripheral surface of the larger-diameter portion 24 of the output shaft 23. The outer peripheral surface of the output shaft 23 is supported in a floated state by a liquid film formed on such sliding portions, whereby the solid contact between the output shaft 23 and the static-pressure bearing 25 can be prevented, and the lubrication is achieved so as to prevent the seizure and wearing from occurring. The pressurized liquid-phase fluid exiting from the pressurized liquid-phase fluid passage W11 lubricates the sliding portions of the outer peripheral surface of the stationary shaft 65 and the inner peripheral surface of the hollow shaft 64 and further lubricates the sliding portions of the outer peripheral surface of the left end of the stationary shaft 65 and the inner peripheral surface of the left end of the hollow bearing tube 21 of the first half 8. The pressurized liquid-phase fluid which has completed the lubrication of the sliding portions of the left and right static-pressure bearings 25 and the output shaft 23 is passed through left and right pressurized liquid-phase fluid passages W13 defined between the rotor 31 and the first and second halves 8 and 9 and discharged to the outside of the casing 7 through the first and second discharge bore groups 110 and 111 (see FIG. 6).

The pressurized liquid-phase fluid which has lubricated the sliding portions of the outer peripheral surface of the larger-diameter solid portion 66 of the stationary shaft 65 and the inner peripheral surface of the hollow shaft 64 is captured in the seal grooves 55 and 56 (see FIGS. 4 and 17) defined in the outer peripheral surface of the stationary shaft 65 to surround the outer peripheries of the first and second seal blocks 92 and 93 received within the stationary shaft 65. The pressure of this pressurized liquid-phase fluid is higher than that of the vapor discharged from the cylinder member 39 and hence, the leakage of the vapor can be prevented in a sealing manner by the pressurized liquid-phase fluid within the seal grooves 55 and 56. The seal grooves 55 and 56 communicate with the first and second recess-shaped discharge portions 102 and 103 (see FIG. 17) of the stationary shaft 65 and hence, the pressurized liquid-phase fluid is supplied from the first and second recess-shaped discharge portions 102 and 103 via the first and second discharge bores 104 and 105 into the junction chamber 20, and is discharged from the junction chamber 20 via the first and second introducing bore groups 107 and 108, the rotor chamber 14 and the first and second discharge bore groups 110 and 111 to the outside of the casing 7.

Figure 18:
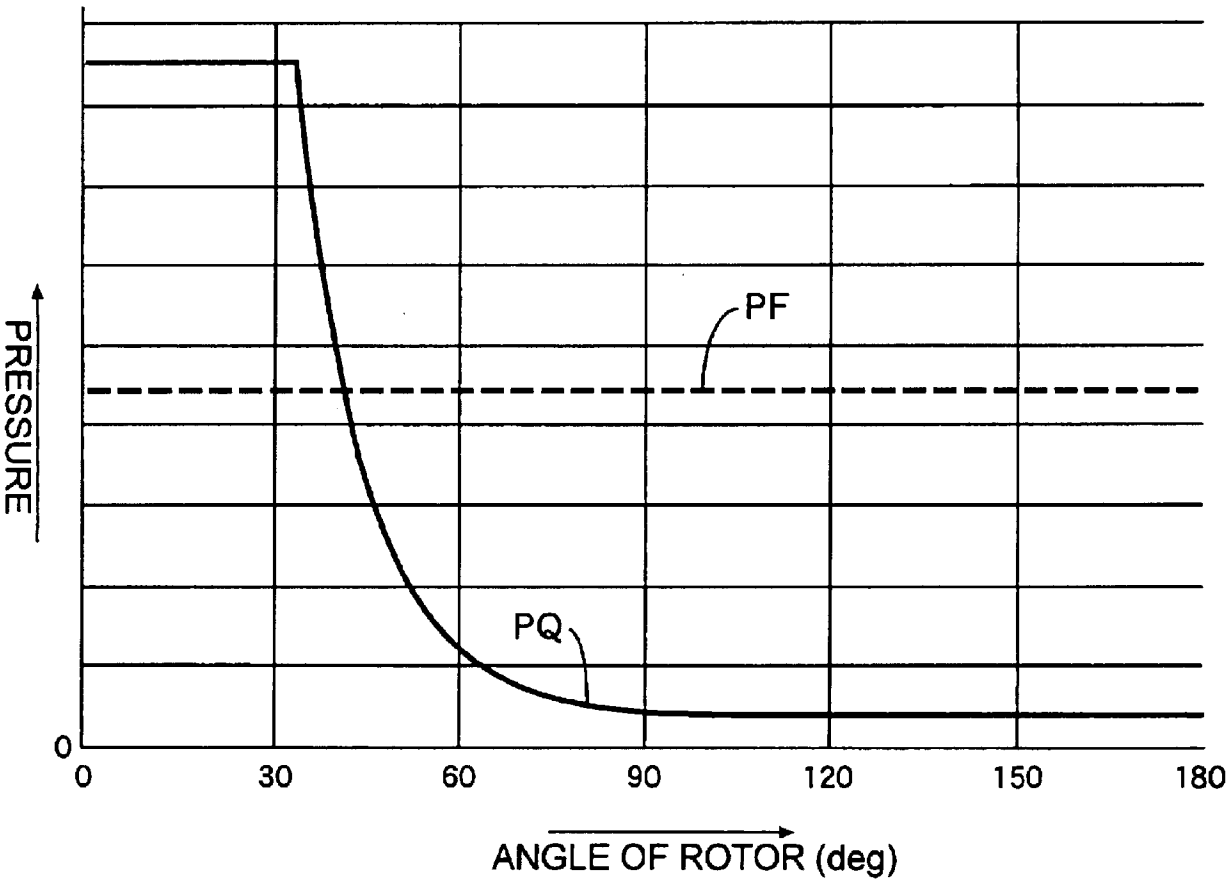

A portion of the pressurized liquid-phase fluid passed through the pressurized liquid-phase fluid passage W13 flows into the slot-shaped space 34 where the vane body 43 slides, and then flows therefrom into the pressurized liquid-phase fluid passages W1 and W2 opening between the pair of projections 53 of the vane body 43. The pressurized liquid-phase fluid passage W2 opening into the radially outer end of the vane body 43 opens into the rotor chamber 14 in a predetermined range of angle at which the vane body 43 protrudes at the largest length from the rotor 31 (see FIG. 11). As shown in FIG. 18, the pressure in the slot-shaped space 34 is a constant value PF. The pressure PF can be set at any level depending on the opening degree of the orifice 54 (see FIG. 2) provided in the first half 8 to communicate with the junction chamber 20. On the other hand, the pressure PQ in the rotor chamber 14 is varied with the rotation of the rotor 31 and hence, if the pressure PF in the slot-shaped space 34 is set in a range where it exceeds the pressure PQ in the rotor chamber 14 (PF>PQ), so that the pressurized liquid-phase fluid passage W2 in the vane body 43 opens into the rotor chamber 14, the pressurized liquid-phase fluid accumulated in the slot-shaped space 34 can be discharged into the rotor chamber 14 through the pressurized liquid-phase fluid passages W1 and W2 in the vane body 43.

Figure 3:
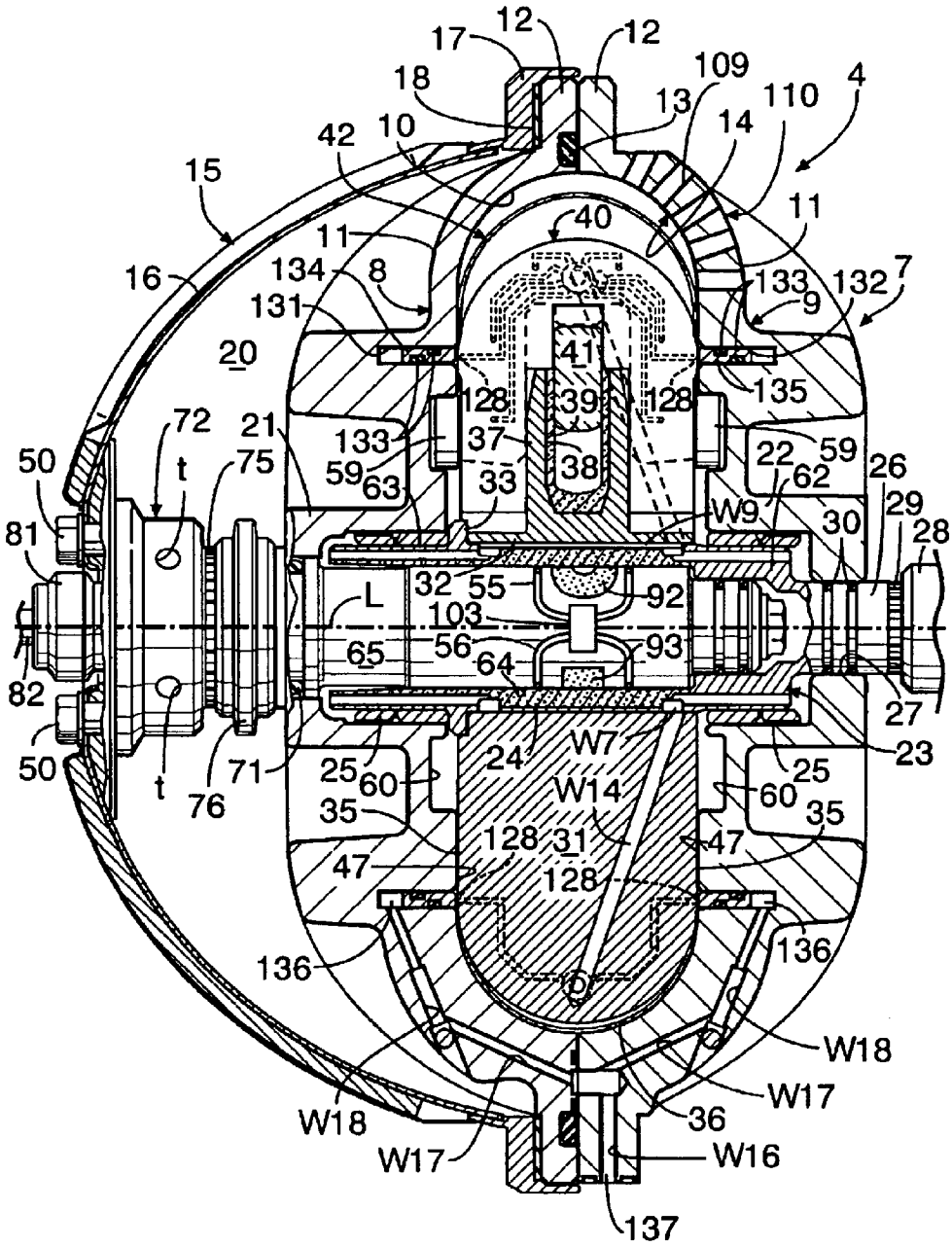

As can be seen from FIGS. 3 and 11, twelve pressurized liquid-phase fluid passages W14 extend radially within the rotor 21 from the annular pressurized liquid-phase fluid passage W7 defined around the outer periphery of the output shaft 23, and are each bifurcated at its outer end into pressurized liquid-phase fluid passages W15 each connected to the orifice-defining member 124 of each of the side plates 40. Therefore, the pressurized liquid-phase fluid supplied from the pressurized liquid-phase fluid feed pipe 130 (see FIG. 4) is moved radially outwards through the pressurized liquid-phase fluid passages W14 and the pressurized liquid-phase fluid passages W15 provided in the rotor 21 and supplied to the orifice-defining members 124 of the side plates 40, while being further pressurized by a centrifugal force, and is then moved therefrom via the pressurized liquid-phase fluid passages W3 in the side plates 40 and ejected from the pressurized liquid-phase fluid discharge bores 127 opening into the vane slide faces 121. Thus, a static-pressure bearing is formed between the side plate 40 and the vane slide face 121 of the vane 42 to support the vane 42 in a floated state, thereby preventing the solid contact of the side plate 40 and the vane 42 with each other to prevent the occurrence of the seizure and the wearing. In this way, by supplying the pressurized liquid-phase fluid for lubricating the vane slide faces 121 of the vanes 42 through the pressurized liquid-phase fluid passages W14 and W15 provided in the rotor 31 and through the pressurized liquid-phase fluid passages W3 provided in the side plates 40, the pressurized liquid-phase fluid can be pressurized by the centrifugal force, and moreover, the temperature around the rotor 32 can be stabilized to decrease the influence due to the thermal expansion, and preset clearances can be maintained to suppress the leakage of the vapor to the minimum. In other words, another static pressure bearing is located radically outside the rotor 31 through passage W14 defined in the rotor 31.

Figure 19:
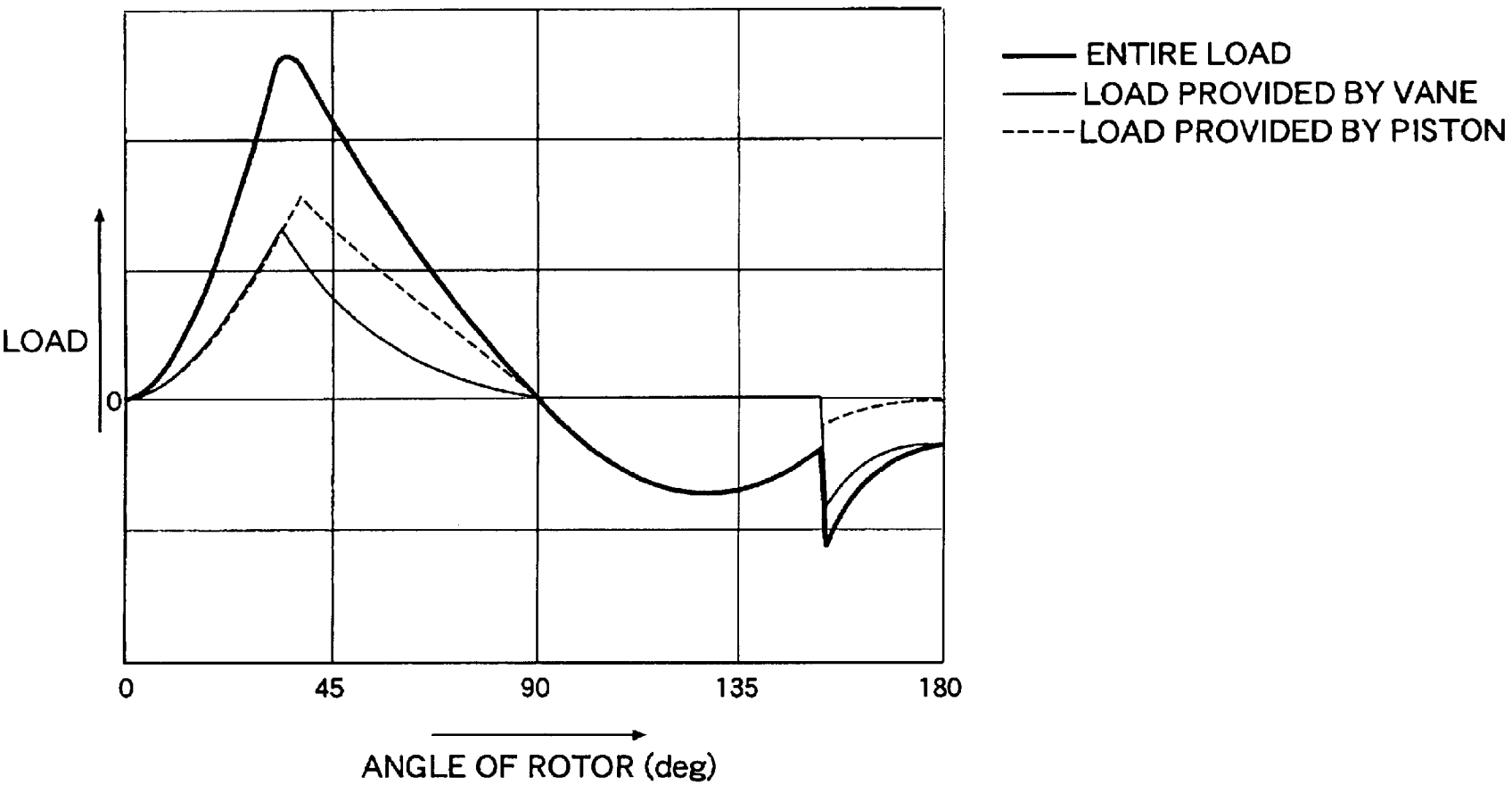

As shown in FIG. 19, a circumferential load applied to each of the vanes 42 (a load in a direction perpendicular to the plate-shaped vane body 43) is a resultant of forces: a load provided by a difference between vapor pressures applied to the front and rear surfaces of the vane body 43 within the rotor chamber 14; and a circumferential component of a reaction force received from the annular groove 60 by the roller 59 mounted on the vane body 43, but these loads are varied periodically depending on the phase of the rotor 31. Therefore, the vane 42, which has received the uneven load, periodically performs such a behavior that the vane 42 is inclined between the pair of side plates 40 clamping the vane 42.

When the vane body 43 is inclined due to the uneven load in the above manner, the clearances between the six pressurized liquid-phase fluid discharge bores 127 opening into each of the side plates 40 and the vane body 43 are changed in size. For this reason, there is a possibility that the liquid film in the widened clearance may flow away, and the pressurized liquid-phase fluid may be difficult to be supplied to the narrowed clearance and thus, the pressure is not increased in the sliding portion, causing the vane body 43 to be brought into direct contact with the vane slide faces 121 of the side plate 40 to become worn. According to the present embodiment, however, the above-described disadvantage is overcome, because the orifices 112 are defined to communicate with the six pressurized liquid-phase fluid passages W3 leading to the six pressurized liquid-phase fluid discharge bores 127 by the orifice-defining member 124 mounted on the side plate 40.

More specifically, if the clearance between the pressurized liquid-phase fluid discharge bore 127 and the vane body 43 is widened, the pressure of supplying of the pressurized liquid-phase fluid is constant and hence, in contrast to the constant difference between the pressures generated across the orifice 112 in a steady state, the flow rate of the pressurized liquid-phase fluid is increased by an increase in amount of fluid flowing out of such clearance, whereby the difference between the pressures generated across the orifice 112 is increased by an orifice effect to decrease the pressure in the clearance. As a result, a force for narrowing the widened clearance to restore the latter to the original state is generated. On the other hand, when the clearance between the pressurized liquid-phase fluid discharge bore 127 and the vane body 43 is narrowed, the amount of fluid flowing out of such clearance is decreased to decrease the difference between the pressures generated across the orifice 112 and as a result, the pressure in the clearance is increased and a force for widening the narrowed clearance to restore the latter to the original state is generated.

Even if the clearance between the pressurized liquid-phase fluid discharge bore 127 and the vane body 43 is changed in size due to the load applied to the vane 42, as described above, the pressure of the pressurized liquid-phase fluid supplied to the clearance is adjusted automatically by the orifice 112 in response to the change in size of the clearance. Therefore, the clearance between the vane body 43 and the side plate 40 can be maintained stably at a desired size. Thus, the liquid film can be normally retained between the vane body 43 and the side plate 40 to support the vane body 43 in the floated state, whereby the occurrence of wear resulting from solid contact of the vane body 43 with the vane slide face 121 of the side plate 40 can reliably be avoided.

In addition, the pressurized liquid-phase fluid is retained in the two recesses 49 defined in each of the opposite sides of the vane body 43 and hence, the recesses 49 are pressure-accumulated portions to suppress a drop in pressure due to the leakage of the pressurized liquid-phase fluid. As a result, the vane body 43 sandwiched between the vane slide faces 121 of the pair of side plates 40 is brought into the floated state by the pressurized liquid-phase fluid, whereby the resistance to the sliding movement can be decreased to a level near the nil. In addition, when the vane 42 is reciprocally moved, the radial position of the vane 42 relative to the rotor 31 is changed, but the vane 42 reciprocally moved can be always retained in the floated state to effectively decrease the resistance to the sliding movement, because the recesses 49 are provided in the vane body 43 rather than in the side plate 40 and provided in the vane body 43 in the vicinity of the rollers 59 to which a load is applied most.

The pressurized liquid-phase fluid which has lubricated the sliding surface of the vane 42 on the side plate 40 is moved radially outwards by the centrifugal force to lubricate the sliding portions of the seal member 44 mounted on the outer peripheral surface of the end of the vane body 32 and the inner peripheral surface of the rotor chamber 14. The pressurized liquid-phase fluid which has completed the lubrication is discharged from the rotor chamber 14 through the first and second discharge bore groups 110 and 111 (see FIG. 6).

As can be seen from FIG. 3, annular grooves 131 and 132 about the axis L are provided in the inner peripheral surfaces of the first and second halves 8 and 9 of the casing 7, and annular ring seals 134 and 135 provided with a pair of O-rings 133 are fitted into the annular grooves 131 and 132. Pressurized liquid-phase fluid discharge bores 128 in the pressurized liquid-phase fluid passages W4 provided in the vane body 43 open into inner ends of the ring seals 134 and 135 opposed to the pair of parallel portions 48 of the vane body 43, so that they are opposed to each other. On the other hand, a pressurized liquid-phase fluid feed port 137 provided in the second half 9 communicates with pressure chambers 136 at outer ends of the annular grooves 131 and 132 through pressurized liquid-phase fluid passages W16, W17 and W18. The pressurized liquid-phase fluid feed port 137 for supplying the pressurized liquid-phase fluid to the ring seals 134 and 135 is another system independent from the pressurized liquid-phase fluid feed bore 129 (see FIG. 4) for supplying the pressurized liquid-phase fluid to various portions of the expander 4.

Thus, the ring seals 134 and 135 are pushed against the opposite sides 35 of the rotor 31 by the pressurized liquid-phase fluid supplied to the pressure chambers 136 as a biasing means defined at bottoms of the annular grooves 131 and 132, and pressurized liquid-phase fluid is supplied from the pressurized liquid-phase fluid discharge bores 128 in the vane body 43 to the sliding surfaces of the inner peripheral surfaces of the ring seals 134 and 135 and the parallel portions 48 of the vane body 43 to form a static-pressure bearing. Thus, the opposite sides 35 of the rotor 31 can be sealed by the ring seals 134 and 135 lying in the floated states within the annular grooves 131 and 132 and as a result, the vapor in the rotor chamber 14 can be prevented from being leaked from the opposite sides 35 of the rotor 31. At this time, the ring seals 134 and 135 and the opposite sides 35 of the rotor 31 cannot be brought into solid contact with each other, because they are isolated from each other by the liquid film of the pressurized liquid-phase fluid supplied from the pressurized liquid-phase fluid discharge bores 128. In addition, even if the rotor 31 is inclined, the ring seals 134 and 135 are inclined within the annular grooves 131 and 132, following the inclination of the rotor 31, whereby a stable sealing performance can be ensured, while minimizing the frictional force.

The ring seals 134 and 135 are non-contact seals and hence, the frictional force is extremely small, and further, the life of the seals is semi-permanent, as compared with contact-type seals and moreover, there is not a possibility that the seizure may occur, because the liquid film is interposed between the ring seals 134 and 135 and the rotor 31. In addition, the slot-shaped space 34 around the stationary shaft 65 is a space closed by the provision of the ring seals 134 and 135 and hence, the leakage of the vapor within the rotor chamber 14 from the opposite sides 35 of the rotor 31 can be further reduced by adjusting the pressure in the slot-shaped space 34 by the orifice 54 (see FIG. 2). The pressurized liquid-phase fluid, which has lubricated the sliding portions of the ring seals 134 and 135 and the opposite sides 35 of the rotor 31, is supplied to the rotor chamber 14 by the centrifugal force and discharged therefrom via the first and second discharge bore groups 110 and 111 to the outside of the casing 7.

Alternatively, the ring seals 134 and 135 may be biased by a repulsion force of a metal spring or a rubber in place of being biased toward the rotor 31 by the pressurized liquid-phase fluid.

In the embodiment described above, in a Ranking cycle comprising the evaporator 3 for generating the high-temperature and high-pressure vapor by heating water by the heat energy of the exhaust gas from the internal-combustion engine 1, the expander 4 for converting the high-temperature and high-pressure vapor supplied from the evaporator 3 into a shaft output of a constant torque, the condenser 5 for liquefying the dropped-temperature and dropper-pressure vapor discharged from the expander 4, and the feed pump 6 for supplying the water liquefied in the condenser 5 to the evaporator 3, the expander 4 of a displacement type is employed. The expander 4 of the displacement type is capable of recovering energy with a high efficiency in a wide range of rotational speed from a low speed to a high speed, as compared with an expander of a non-displacement type such as a turbine, and moreover, is excellent in following property and in responsiveness to a variation in heat energy of the exhaust gas (a variation in temperature of the exhaust gas or a variation in flow rate) attendant on an increase or decrease of the rotational speed of the internal combustion engine 1. Moreover, the expander 4 is constructed into a double-expansion type in which a first energy converting means comprised of the cylinder members 39 and the pistons 41 and a second energy converting means comprised of the vanes 42 are disposed at radially inner and outer locations and connected in series to each other. Therefore, the efficiency of recovery of the heat energy by the Ranking cycle can be further enhanced, while providing an enhancement in space efficiency by reducing the size and weight of the expander 4.

The water as a medium for operating the expander 4 is also used as the lubricating pressurized liquid-phase fluid and hence, the various portions of the expander 4 to be lubricated can be lubricated by the static-pressure bearing without need for a special lubricating oil, whereby the occurrence of the seizure and the wearing can be prevented. Moreover, a lubricating oil cannot be incorporated into the water which is the operating medium and hence, an adverse influence due to the mixing of the water and the lubricating oil can be avoided. Further, the supporting of the output shaft 23 on which the rotor 31 is supported rotatably, the supporting of vane 42 in the slot-shaped space 34 and the supporting of the ring seals 134 and 135 on the opposite sides 35 of the rotor 31 are achieved by the static-pressure bearings and hence, the solid contact of the sliding portions can be prevented to reliably prevent the occurrence of the seizure and the wearing.

Figure 20:
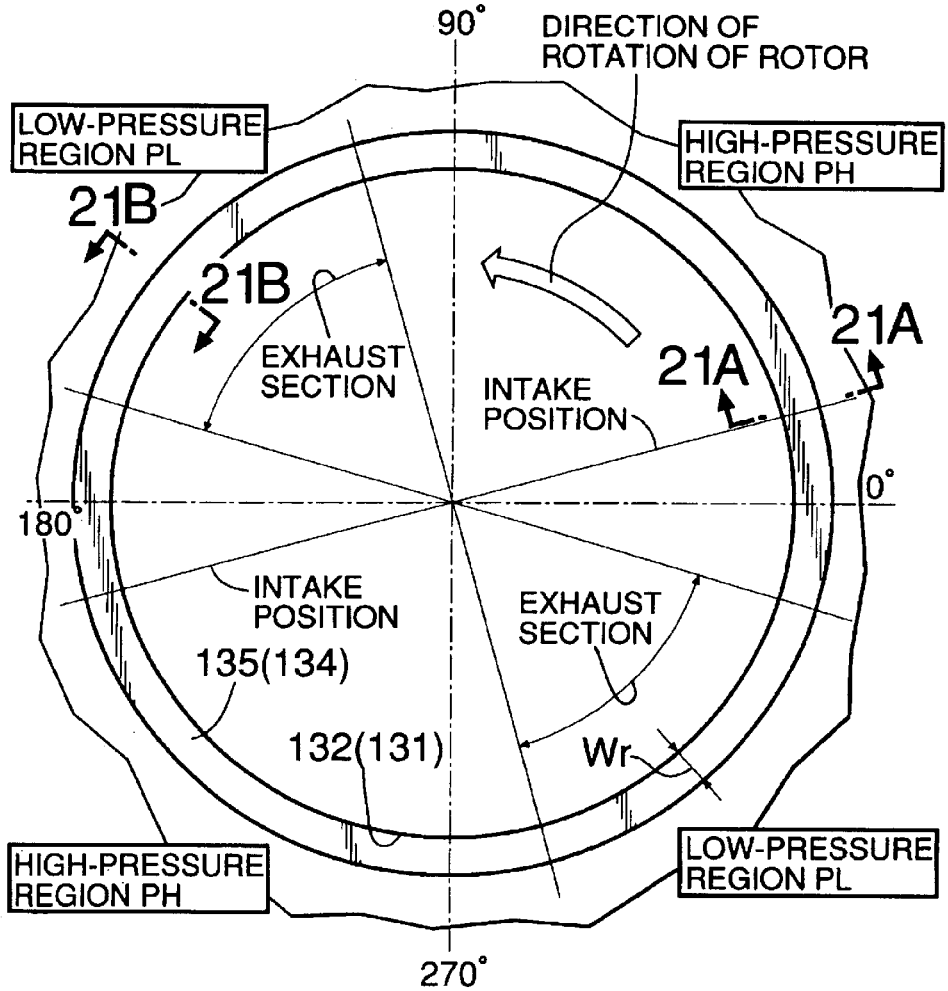

A second embodiment of the present invention will now be described with reference to FIGS. 20 and 21.

An O-ring 133 forming a seal member in the second embodiment is formed into an annular shape from a rubber or another elastomeric material. A sealing surface 141 of each of ring seals 134 and 135 opposed to opposite sides 35 of a rotor 31 has a constant diametrical width Wr, and has the same sectional shape at all of circumferential points. A pair of notches 142 are defined at ends of the ring seals 134 and 135 opposite from the rotor 31, and the O-rings 133 are supported between the pair of notches 142 and bottom surfaces 138 of annular grooves 131 and 132. The depth Dg of the bottom surface 138 of each of the annular grooves 131 and 132 is not constant in the circumferential direction, and is varied depending on the pressure of vapor within a rotor chamber 14.

More specifically, if the phase of one of shorter-diameter positions E of the rotor chamber 14 is 0°, a region of 0° to 90° and a region of 180° to 270°, in which first and second introducing bore groups 107 and 108 for supplying vapor are opened, are high-pressure regions PH, and a region of 90° to 180° and a region of 270° to 360°, in which first and second discharge bore groups 110 and 111 for discharging the vapor are opened, are low-pressure regions PL. The depth Dg of each of the annular grooves 131 and 132 assumes a minimum value Dg (min) in a position where the vapor pressure is the highest, as shown by a sectional line 21A—21A in FIG. 20, i.e., in a position slightly delayed in a rotational direction from an intake position in which the first and second introducing bore groups 107 and 108 are opened. On the other hand, the depth Dg of each of the annular grooves 131 and 132 assumes a maximum value Dg (max) in a position where the vapor pressure is the lowest, as shown by a sectional line 21B—21B in FIG. 20, i.e., in an exhaust section in which the first and second discharge bore groups 110 and 111 are opened. The depth Dg is continuously varied between the position where the depth Dg of each of the annular grooves 131 and 132 assumes the minimum value Dg (min) and the section where the depth Dg assumes the maximum value Dg (max).

Thus, the opposite sides 35 of the rotor 31 can be sealed by the ring seals 134 and 135 by pushing the ring seals 134 and 135 to the opposite sides 35 of the rotor 31 by the O-rings 133 as the biasing means, and by supplying the pressurized liquid-phase fluid from a pressurized liquid-phase fluid discharge bores 128 in a vane body 43 to sliding surfaces of the sealing surfaces 141 of the ring seals 134 and 135 and parallel portions 48 of the vane body 43 to form a static-pressure bearing. As a result, the vapor in the rotor chamber 14 can be prevented from being leaked from the opposite sides 35 of the rotor 31. At this time, the ring seals 134 and 135 and the opposite sides 35 of the rotor 31 are isolated from each other the liquid film of the pressurized liquid-phase fluid supplied from the pressurized liquid-phase fluid discharge bores 128 and hence, cannot be brought into solid contact with each other. Even if the rotor 31 is inclined, the ring seals 134 and 135 are inclined within the annular grooves 131 and 132, following the inclination of the rotor 31, whereby a stable sealing performance can be ensured, while minimizing the frictional force.

The ring seals 134 and 135 are non-contact seals and hence, the frictional force is extremely small, and further, the life of the seals is semi-permanent, as compared with contact-type seals and moreover, there is not a possibility that the seizure may occur, because the liquid film is interposed between the ring seals 134 and 135 and the rotor 31. In addition, the slot-shaped space 34 around the stationary shaft 65 is a space closed by the provision of the ring seals 134 and 135 and hence, the leakage of the vapor within the rotor chamber 14 from the opposite sides 35 of the rotor 31 can be further reduced by adjusting the pressure in the slot-shaped space 34 by the orifice 54 (see FIG. 2). The pressurized liquid-phase fluid, which has lubricated the sliding portions of the ring seals 134 and 135 and the opposite sides 35 of the rotor 31, is supplied to the rotor chamber 14 by the centrifugal force and discharged therefrom via the first and second discharge bore groups 110 and 111 to the outside of the casing 7.

Figure 21A:
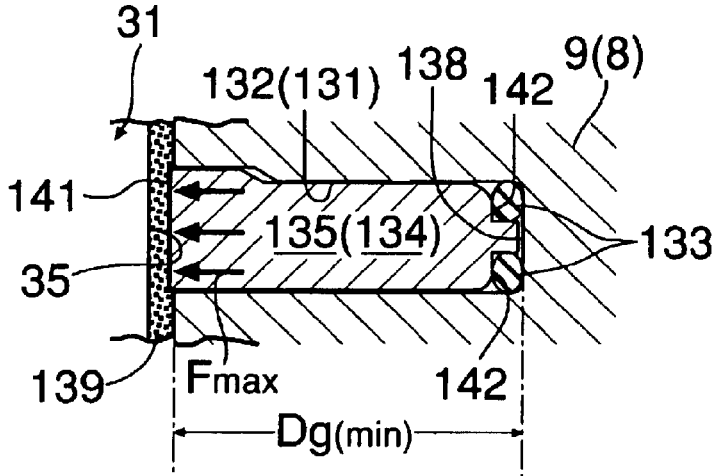
FIG. 21A is a sectional view taken along a line 21A—21A in FIG. 20.
Figure 21B:
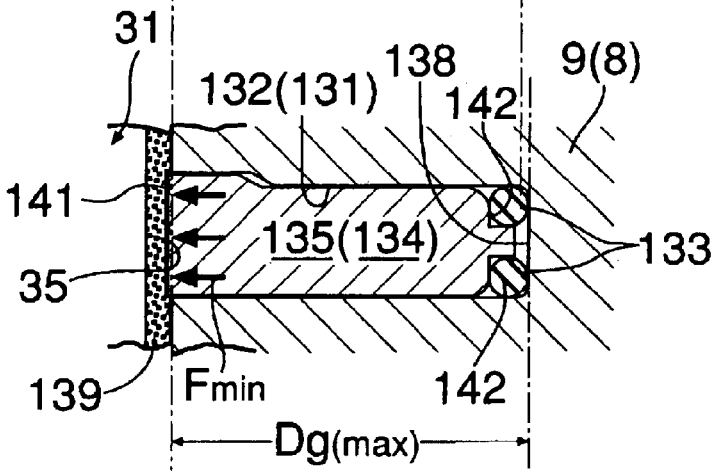

Especially, because the depth Dg of each of the annular grooves 131 and 132 assumes the minimum value Dg (min) in the position where the vapor pressure in the rotor chamber 14 is the highest, as shown in FIG. 21A, the O-rings 133 are compressed strongly between the notches 142 of the ring seals 134 and 135 and the bottom surfaces 138 of the annular grooves 131 and 132 to bias the ring seals 134 and 135 toward the opposite sides 35 of the rotor 31 by a large biasing force Fmax. On the other hand, because the depth Dg of each of the annular grooves 131 and 132 assumes the maximum value Dg (max) in the section where the vapor pressure in the rotor chamber 14 is the lowest, as shown in FIG. 21B, the O-rings 133 are compressed weakly between the notches 142 of the ring seals 134 and 135 and the bottom surfaces 138 of the annular grooves 131 and 132 to bias the ring seals 134 and 135 toward the rotor 31 by a small biasing force Fmin.

As a result, even if the vapor pressure in the high-pressure region PH is about to be leaked from a clearance between the casing 7 and the rotor 31, the ring seals 134 and 135 can be biased toward the rotor 31 by the sufficiently large biasing force Fmax to reliably prevent the leakage of the vapor pressure. The possibility of the leakage of the vapor pressure from the clearance between the casing 7 and the rotor 31 is small in the low-pressure region PL and hence, the ring seals 134 and 135 can be biased toward the rotor 31 by the biasing force Fmin of a necessary minimum level, thereby reducing the frictional resistance to minimize the energy loss. In this way, an appropriate water film 139 can be retained between the ring seals 134 and 135 and the opposite sides 35 of the rotor 31 by changing the biasing force for the circumferential portions of the ring seals 134 and 135 in correspondence to the distribution of the high-pressure regions PH and the low-pressure regions PL in the rotor chamber 14, thereby reconciling both of the ensuring of a sealability and the reduction in frictional resistance.

Figure 22:
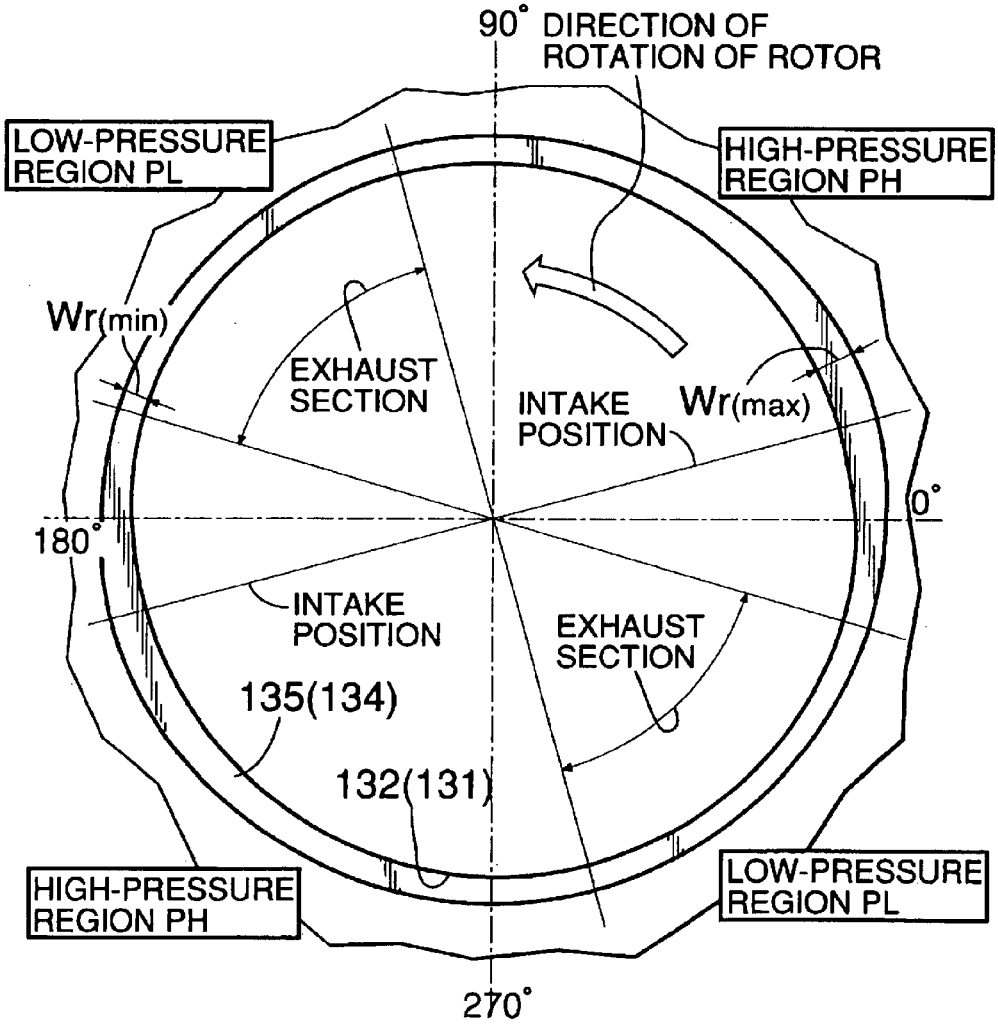
FIG. 22 is a front view of a ring seal mounted on the casing, according to a third embodiment of the present invention.

A third embodiment of the present invention will now be described with reference to FIG. 22.

The diametrical width Wr of each of ring seals 134 and 135 in the third embodiment is varied circumferentially, and the depth Dg of each of annular grooves 131 and 132 is also varied circumferentially. More specifically, as in FIG. 21A, the depth Dg of each of annular grooves 131 and 132 assumes a minimum value Dg (min) in a position where the vapor pressure in the rotor chamber 14 is the highest. Thus, the ring seals 134 and 135 are biased toward the opposite sides 35 of the rotor 31 by a large biasing force Fmax. As in FIG. 21B, the depth Dg of each of the annular grooves 131 and 132 assumes a maximum value Dg (max) in a position where the vapor pressure in the rotor chamber 14 is the lowest. Thus, the ring seals 134 and 135 are biased toward the opposite sides 35 of the rotor 31 by a small biasing force Fmin. Therefore, the biasing force for biasing the ring seals 134 and 135 toward the rotor 31 by the O-rings 133 is uniform in the circumferential direction. The diametrical width Wr of each of ring seals 134 and 135 assumes a maximum value Wr (max) in the position where the vapor pressure is the highest, and assumes a minimum value Wr (min) in the section where the vapor pressure is the lowest, and the diametrical width Wr is varied continuously between the position where it assumes the maximum value Wr (max) and the section where it assumes the minimum value Wr (min).

Portions of the ring seals 134 and 135 each having a larger width Wr are formed, so that the ring seals 134 and 135 are prevented from being flexed especially in an axial direction by the vapor pressure, whereby a sealability can be ensured between the ring seals 134 and 135 and the opposite sides 35 of the rotor 31. Portions of the ring seals 134 and 135 each having a small width Wr only requires a rigidity as high as the ring seals 134 and 135 are not flexed by the vapor pressure or by a load from the rotor 31. These portions can be formed at the small width, so that small biasing force suffices, and hence, it is possible to alleviate the frictional resistance between the ring seals 134 and 135 and the opposite sides 35 of the rotor 31.

As described above, the rigidity of each of the ring seals 134 and 135 is varied in the circumferential direction, so that each of the circumferential portions has a rigidity as high as the ring seals 134 and 135 are not flexed by the vapor pressure or by the load. Therefore, the sealability can be ensured, while alleviating the frictional resistance between the ring seals 134 and 135 and the opposite sides 35 of the rotor 31 and to prevent increases in sizes of the rotor seals and the entire expander 4.

Figure 23:
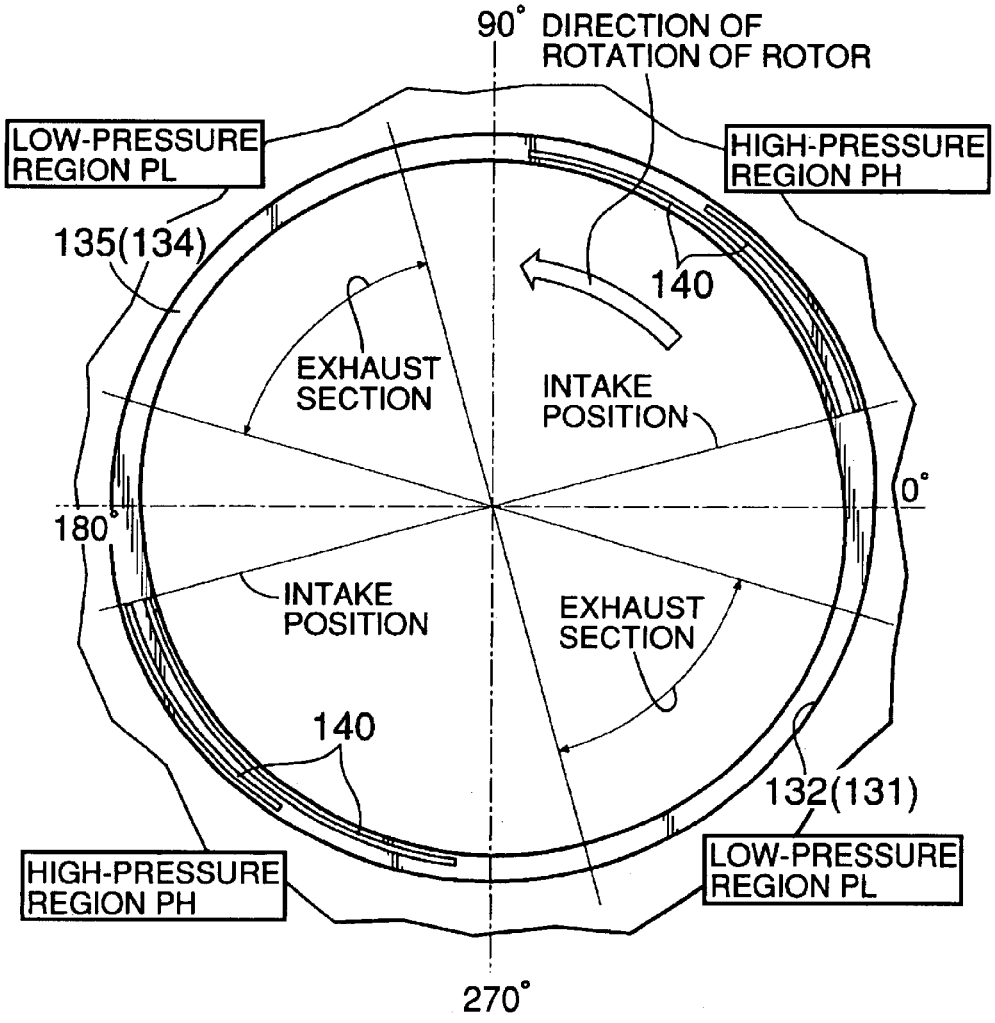
FIG. 23 is a front view of a ring seal mounted on the casing, according to a fourth embodiment of the present invention.

A fourth embodiment of the present invention will be described below with reference to FIG. 23.

Ring seals 134 and 135 in the fourth embodiment are improvements in the ring seals 134 and 135 in the third embodiment, and each include two recesses 140 provided in its sealing surface 141 corresponding to a high-pressure region PH to extend in a circumferential direction. Water films 139 between the ring seals 134 and 135 and the opposite sides 35 of the rotor 31 enter into the recesses 140 to exhibit a labyrinth effect and hence, the sealability of the ring seals 134 and 135 can be further enhanced. Other functions and effects are the same as in the third embodiment.

The recesses 140 are provided in the ring seals 134 and 135 for the purpose of enhancing the sealability in the fourth embodiment, thereby exhibiting the labyrinth effect, but on the contrary, in consideration of a sealing surface pressure per unit area, an arcuate projection having a small width may be formed on each of the ring seals 134 and 135 in a high-pressure region, and an arcuate projection having a large width may be formed on each of the ring seals 134 and 135 in a low-pressure region. Even in this case, a similar sealing effect can be provided.

In each of the above-described embodiments, in the Ranking cycle comprised of the evaporator 3 for generating the high-temperature and high-pressure vapor by heating the water by the heat energy of the exhaust gas from the internal combustion engine 1, the expander 4 for converting the high-temperature and high-pressure vapor supplied from the evaporator 3 into the shaft output of the constant torque, the condenser 5 for liquefying the dropped-temperature and dropped-pressure vapor discharged from the expander 4, and the feed pump 6 for supplying the water liquefied in the condenser 5 to the evaporator 3, the expander 4 of a displacement type is employed. The expander 4 of the displacement type is capable of recovering energy with a high efficiency in a wide range of rotational speed from a low speed to a high speed, as compared with an expander of a non-displacement type such as a turbine, and moreover, is excellent in following property and in responsiveness to a variation in heat energy of the exhaust gas (a variation in temperature of the exhaust gas or a variation in flow rate) attendant on an increase or decrease of the rotational speed of the internal combustion engine 1. Moreover, the expander 4 is constructed into a double-expansion type in which a first energy converting means comprised of the cylinder members 39 and the pistons 41 and a second energy converting means comprised of the vanes 42 are disposed at radially inner and outer locations and connected in series to each other. Therefore, the efficiency of recovery of the heat energy by the Ranking cycle can be further enhanced, while providing an enhancement in space efficiency by reducing the size and weight of the expander 4.

The water as a medium for operating the expander 4 is also used as the lubricating pressurized liquid-phase fluid and hence, the various portions of the expander 4 to be lubricated can be lubricated by the static-pressure bearing without need for a special lubricating oil, whereby the occurrence of the seizure and the wearing can be prevented. Moreover, a lubricating oil cannot be incorporated into the water which is the operating medium and hence, an adverse influence due to the mixing of the water and the lubricating oil can be avoided. Further, the supporting of the output shaft 23 on which the rotor 31 is supported rotatably, the supporting of vane 42 in the slot-shaped space 34 and the supporting of the ring seals 134 and 135 on the opposite sides 35 of the rotor 31 can be achieved by the static-pressure bearings and hence, the solid contact of the sliding portions can be prevented to reliably prevent the occurrence of the seizure and the wearing.

Although the embodiments of the present invention have been described in detail, it will be understood that various modifications in design may be made without departing from the subject matter of the invention.

For example, the water which is the medium for operating the expander 4 is also used as the pressurized liquid-phase fluid for the static-pressure bearing in each of the embodiments, but an oil or the like different from the medium for operating the expander 4 may be used as the pressurized liquid-phase fluid for the static-pressure bearing, whereby the lubrication and the sealability between the members such as the vane 42, the rotor 31, the casing 7, the output shaft 23 and the like can be further enhanced. In this case, the pressurized liquid-phase fluid for the static-pressure bearing is mixed into the medium for operating the expander 4, but there is no hindrance, if a separating device for separating the operating medium and the pressurized liquid-phase fluid from each other is placed. However, if the medium for operating the expander 4 is also used as the pressurized liquid-phase fluid for the static-pressure bearing as in each of the above-described embodiments, the device for separating the operating medium and the pressurized liquid-phase fluid from each other is not required.

In addition, the ring seals 134 and 135 are biased toward the opposite sides 35 of the rotor 31 by the water pressure in each of the embodiments, but they may be biased by a resilient member such as a spring and the like.

Further, the ring seals 134 and 135 are mounted on the casing 7 in each of the embodiments, but they may be mounted on the rotor 31.

Furthermore, the O-ring 133 is employed as a biasing means in each of the embodiments, but another biasing means such as a spring may be employed, if it generates a repulsion force.

INDUSTRIAL APPLICABILITY

As discussed above, the rotary fluid machine according to the present invention is applicable particularly effectively to an expander in a Ranking cycle system, but it is also applicable to an expander used in any other application.

What is claimed is:

1. A rotary fluid machine comprising:

a casing having a rotor chamber, a rotor accommodated in said rotor chamber, and a plurality of vane piston units disposed in said rotor radially about a rotational axis of said rotor for reciprocal movement in a radial direction, each of said vane piston units comprising a vane slidable in said rotor chamber and a piston abutting against a non-sliding portion of said vane, wherein said piston is operated by the expansion of a high-pressure gas-phase operating medium to rotate said rotor through a power-converting device and to rotate said rotor through said vanes by the expansion of a low-pressure gas-phase operating medium resulting from the drop in pressure of said high-pressure gas-phase operating medium, wherein a pressurized liquid-phase fluid is supplied to a static-pressure bearing on an output shaft rotated in unison with said rotor to support said output shaft in a static-pressure manner, and a portion of said pressurized liquid-phase fluid is supplied to another static-pressure bearing located at a radially outer portion of said rotor through passages defined in said rotor.

2. The rotary fluid machine according to claim 1, wherein the other static-pressure bearing supports the vane in the static-pressure manner in a slot-shaped space defined in said rotor.

3. The rotary fluid machine according to claim 1, wherein the other static-pressure bearing supports the side face of said rotor on the inner surface of said casing in the static-pressure manner.

4. The rotary fluid machine according to claim 1, wherein said pressurized liquid-phase fluid is the same fluid as the gas-phase operating medium.

5. A rotary fluid machine for a high-pressure gas-phase operating medium comprising:

a casing having a rotor chamber, a rotor accommodated in said rotor chamber, and a plurality of vanes supported for reciprocal movement in slot-shaped spaces defined in said rotor radially about a rotational axis of said rotor, wherein said rotor chamber is divided into a plurality of mutually adjacent chamber section by cooperation of the casing, rotor and vanes, said rotor is rotated through said vanes by the expansion of the high-pressure gas-phase operating medium supplied into to the rotor chamber, wherein a static-pressure bearing is formed in said slot-shaped space between said rotor and said vane, so that said vane is supported in a floated state by the static-pressure bearing and that a sealed state of the high-pressure gas-phase operating medium supplied into each of the chamber sections against the operating medium within adjacent chamber sections is kept by the static-pressure bearing.

6. The rotary fluid machine according to claim 5, wherein said static-pressure bearing is formed to support said vane in the floated state by ejecting a pressurized liquid-phase fluid from said rotor onto a surface of said vane.

7. The rotary fluid machine according to claim 5, wherein recesses for retaining a pressurized liquid-phase fluid are defined in the surface of each of said vanes.

8. The rotary fluid machine according to claim 6, wherein said pressurized liquid-phase fluid is the same fluid as said gas-phase operating medium.

9. A rotary fluid machine comprising:

a casing having a rotor chamber, a rotor accommodated in said rotor chamber, and a plurality of vanes reciprocally movably supported in slot-shaped spaces defined in said rotor radially about a rotational axis of said rotor, wherein said rotor is rotated through said vanes by the expansion of a high-pressure gas-phase operating medium supplied into said rotor chamber, wherein annular sealing means are disposed between side faces of said rotor and an inner surface of said casing and biased from one of said rotor and said casing toward the other member, and a pressurized liquid-phase fluid is supplied between said other member toward which the annular sealing means is biased and said sealing means to form a static-pressure bearing, thereby preventing the leakage of the gas-phase operating medium from said rotor chamber.

10. The rotary fluid machine according to claim 9, wherein said sealing means are retained within annular grooves defined in the inner surface of said casing, so that backs of said sealing means are pushed and biased toward the side faces of said rotor by biasing means provided on bottoms of said annular grooves.

11. The rotary fluid machine according to claim 9, wherein said pressurized liquid-phase fluid is the same fluid as said gas-phase operating medium.

12. The rotary fluid machine according to claim 9, wherein said rotor is rotated through said vanes by the expansion of a high-pressure gas-phase operating medium supplied into said rotor chamber, wherein said rotor chamber includes a high-pressure region where the high-pressure gas-phase operating medium is expanded, and a low-pressure region where the low-pressure gas-phase operating medium resulting from the expansion of the high-pressure gas-phase operating medium is discharged, and the sealability of said sealing means is higher in said high-pressure region than in said low-pressure region.

13. The rotary fluid machine according to claim 12, wherein biasing means are provided for biasing said sealing means from the side of said casing toward said rotor by a repulsion force, the repulsion force of said biasing means being stronger in said high-pressure region than in said low-pressure region.

14. The rotary fluid machine according to claim 12, wherein a diametrical width of said sealing means is larger in said high-pressure region than in said low-pressure region.

* * * * *